US009021846B2

(12) United States Patent
Hu

(10) Patent No.: US 9,021,846 B2
(45) Date of Patent: May 5, 2015

(54) METHOD FOR MAKING METAL BODY AND METAL BOX BY USING HYDROFORMING

(71) Applicant: Technology on Prototyping Ultimate (TOPU), Pingtung County (TW)

(72) Inventor: Hui-Wen Hu, Pingtung County (TW)

(73) Assignee: Technology on Prototyping Ultimate (TOPU), Pingtung County (TW)

( * ) Notice: Subject to any disclaimer, the term of this patent is extended or adjusted under 35 U.S.C. 154(b) by 0 days.

(21) Appl. No.: 14/146,755

(22) Filed: Jan. 3, 2014

(65) Prior Publication Data

US 2014/0196514 A1 Jul. 17, 2014

(30) Foreign Application Priority Data

Jan. 4, 2013 (TW) ..... 102100276
Apr. 24, 2013 (TW) ..... 102114662

(51) Int. Cl.

| | |
|---|---|
| ***B21D 26/02*** | (2011.01) |
| ***B21D 26/049*** | (2011.01) |
| ***B21D 26/041*** | (2011.01) |
| ***B21D 26/043*** | (2011.01) |
| ***B21D 26/033*** | (2011.01) |
| ***B21D 51/52*** | (2006.01) |

(52) U.S. Cl.

CPC ..... *B21D 26/049* (2013.01); *B21D 26/02* (2013.01); *B21D 26/041* (2013.01); *B21D 26/043* (2013.01); *B21D 26/033* (2013.01); *B21D 51/52* (2013.01)

(58) Field of Classification Search

CPC .... B21D 26/033; B21D 26/02; B21D 26/041; B21D 26/043; B21D 26/049

USPC ..... 72/57, 58, 60, 61, 62, 370.22; 29/421.1

See application file for complete search history.

(56) References Cited

U.S. PATENT DOCUMENTS

| | | | | | |
|---|---|---|---|---|---|
| 1,711,445 | A * | 4/1929 | Burvenick | 72/58 |
| 2,649,067 | A * | 8/1953 | Kranenberg | 72/60 |
| 3,820,369 | A * | 6/1974 | Tominaga et al. | 72/55 |
| 4,265,102 | A * | 5/1981 | Shimakata et al. | 72/58 |
| 4,362,037 | A * | 12/1982 | Whitfield | 72/52 |
| 5,097,689 | A * | 3/1992 | Pietrobon | 72/58 |
| 5,214,948 | A * | 6/1993 | Sanders et al. | 72/58 |
| 6,182,487 | B1 * | 2/2001 | Komiya et al. | 72/58 |
| 6,237,382 | B1 * | 5/2001 | Kojima et al. | 72/58 |
| 7,484,393 | B2 * | 2/2009 | Tomizawa | 72/57 |
| 7,726,162 | B2 * | 6/2010 | Druesne et al. | 72/58 |

* cited by examiner

*Primary Examiner* — David B Jones

(74) *Attorney, Agent, or Firm* — Tim Tingkang Xia, Esq.; Morris, Manning & Martin, LLP

(57) ABSTRACT

A hydroforming method for metal produces hardware having a throat in only one side and having approximately right-angled corners without causing thinning and breakage. The method includes using a working fluid to exert a liquid pressure on a metal embryo and cooperating with a push rod of a hydroforming mold to supply material from the lower edge, forcing the side sheet metals to bulge. Furthermore, by using the hydroforming mold to provide a downwardly pressing active force on the metal embryo, under feeding of the downwardly pressing active force cooperating with continuous liquid pressure, the metal embryo deforms and bulges such that each corner of the metal embryo and the wall corners of the die cavity of the hydroforming mold have approximately the same angles. Hardware, every angle of which approximates a right angle, can be obtained after removing the hydroforming mold. This method can also be used to obtain a metal box.

19 Claims, 23 Drawing Sheets

METHOD FOR MAKING METAL BODY AND METAL BOX BY USING HYDROFORMING

BACKGROUND OF THE INVENTION

1. Field of the Invention

The present invention relates to a hydroforming method and, more particularly, to a hydroforming method for making hardware and a metal box having approximately right-angled corners.

2. Description of the Related Art

Conventional thin shell metal products are generally made by punching, casting or forging. However, punching, casting, or forging can not easily achieve production of metal products with a specific shape, particularly hardware and metal boxes having a dramatic change in the geometric shape, such as a corner having a small radius, or a circular, elliptic, rectangular, or polygonal shape having a throat in only one side. Thus, in order to increase the appearance variety of the metal products for wide applications in casings for electronic gadgets, such as cell phones, cameras, computer main units, and televisions, or oil tank casings for vehicles, current manufacturers can only choose a milling technique for production.

Taking production of hardware having a rectangular shape by using a conventional milling technique, a metal block is firstly cut to remove redundant material, forming a box-shaped embryo having a predetermined box shape. Then, each corner of the box-shaped embryo is repeatedly milled until each corner approaches the desired special angle (such as a right angle). A metal box having a special angle is, thus, produced.

However, hardware and metal boxes having a special angle produced by the conventional milling technique always lead to excessive material waste due to over cutting of material during the cutting procedure, resulting in a burden to the costs. Furthermore, more tooling processes are required to form the predetermined angle in each corner of the box-shaped embryo by milling, resulting in complex procedures and lack of utility.

Therefore, other manufacturers choose hydroforming to produce hardware and metal boxes having a special angle. Taking sheet metal hydroforming as an example, a liquid pressure is continuously applied to a side of a sheet metal, and a punch of a hydroforming machine pushes the other side of the sheet metal, forcing the sheet metal to tightly abut the outline of the punch under the action of the liquid pressure and gradually shaping the sheet metal into hardware having a special angle as the punch is fed. However, when the corner of the hardware is a special corner with an approximately right angle (a small radius R), the material of the sheet metal can not smoothly flow into each corner due to the excessively small angle of the corner to be formed. This causes gradual thinning at the upper or lower portion of each corner, such that the sheet metal breaks during expansion of the corners, because the remaining material can not be supplied to the corners of the sheet metal and causes thinning at the corners. Furthermore, the shaping method by feeding the punch can not produce hardware and metal boxes having a throat in only one side, either.

Thus, it is necessary to develop a method sufficient to solve the above problems and suitable for producing hardware and metal boxes having various shapes, such that the hardware and the metal boxes can not only have a throat in only one side but can have approximately right-angled corners without thinning and breakage.

SUMMARY OF THE INVENTION

The primary objective of the present invention is to provide a hydroforming method for metal to mitigate the above disadvantages. The method can form hardware and metal boxes having a throat in only one side and having approximately right-angled corners without thinning and breakage in each corner.

To fulfill the above objective, a hydroforming method for metal according to the present invention includes preparing a hydroforming mold, with the hydroforming mold including side dies, a punch, and a push rod to define a die cavity; providing a metal embryo, with the metal embryo including a bottom and a plurality of side walls, with the bottom and the plurality of side walls together defining an interior space, with the interior space having an opening; placing the metal embryo into the die cavity, with the punch pressing against the bottom of the metal embryo, with the push rod facing the opening; filling the interior space of the metal embryo with a working fluid via the opening of the metal embryo, with the working fluid exerting a pressure on the metal embryo; moving the push rod toward the die cavity, with the push rod pressing against the working fluid and top edges of the plurality of side walls of the metal embryo to bulge the plurality of side wall of the metal embryo; and moving the punch toward the die cavity to press the metal embryo to abut a peripheral wall of the die cavity and to fill corners of the peripheral wall of the die cavity, forming hardware.

The punch is moved away from the die cavity while the push rod is moving toward the die cavity, and a velocity of the punch is smaller than a pushing velocity of the push rod.

The punch is moved toward the die cavity before the push rod pushes the working fluid toward the die cavity, thereby squeezing the metal embryo.

The punch is moved toward the cavity before the push rod pushes the working fluid toward the cavity, thereby squeezing the metal blank.

The punch presses against all or a portion of the bottom.

The working fluid continuously fills the interior space via the opening of the metal embryo to assure that the working fluid provides a continuous liquid pressure in the interior space.

The method further includes removing the hydroforming mold and obtaining the hardware; and cutting redundant material of the hardware.

The side dies and the punch form a first corner.

A shoulder extends from a portion of each side die adjacent to the push rod, and the shoulder and the side die form a second corner. The push rod includes a fluid injection channel through which the working fluid is filled.

A maximum inner radius of each corner of the hardware is 1.7 mm when a thickness of the sheet metal of the hardware at the corner of the die cavity is 1.5 mm.

A shape of the metal embryo is same as the die cavity defined by the punch and the push rod.

The metal embryo is circular, elliptic, rectangular, or polygonal.

To fulfill the above objective, a hydroforming method for a metal box according to the present invention includes preparing a hydroforming mold including side dies, a punch, and a push rod; providing a metal box embryo, with the metal box embryo including a plurality of walls and having an opening; placing the metal box embryo into a die cavity formed by the side dies, the punch, and the push rod of the hydroforming mold, with the punch pressing against one of the plurality of walls of the metal box embryo; filling a working fluid into the die cavity of the hydroforming mold, with the working fluid filling an interior of the metal box embryo via the opening of the metal box embryo, with the working fluid exerting a pressure on the metal box embryo to bulge remaining walls outward, and feeding the push rod of the hydroforming mold toward an interior of the die cavity until the remaining walls of the metal box embryo keep bulging into the die cavity and pressing against the side dies of the hydroforming mold; and operating the punch of the hydroforming mold to feed the punch toward the die cavity to press the metal box embryo, causing each corner of the metal box embryo to deform toward a peripheral wall of the die cavity and to fill each approximately right-angled corner formed by the peripheral wall of the die cavity, and then removing the hydroforming mold.

The punch is moved away from the die cavity while feeding the push rod of the hydroforming mold toward the interior of the die cavity, forcing the wall of the metal box embryo to bulge and press against the punch and the side dies.

The approximately right-angled corners of the peripheral wall of the die cavity include a set of lower edge wall corners and a set of upper edge wall corners. The lower edge wall corners are located adjacent to the push rod, and the upper edge wall corners are located adjacent to the punch.

When the punch of the hydroforming mold is operated to feed into the die cavity, the punch exerts a downward pressing force to one of the walls of the metal box embryo, causing each corner of the metal box embryo to deform and expand to fill the lower and upper edge wall corners of the die cavity.

A metal box is obtained after removing the hydroforming mold. The metal box includes a plurality of side walls and an object-placing opening. Redundant material at the object-placing opening is cut after forming the metal box.

A minimal radius of each corner of the peripheral wall of the metal box is 1.7 mm when a thickness of the sheet metals of the metal box at the upper edge wall corners and the lower edge wall corners of the die cavity is 1.5 mm.

The push rod includes a fluid injection channel through which the working fluid is filled.

DETAILED DESCRIPTION OF THE INVENTION

The above and other objectives, features, and advantages of the present invention will become clearer in light of the following detailed description of illustrative embodiments of this invention described in connection with the drawings.

Figure 1:
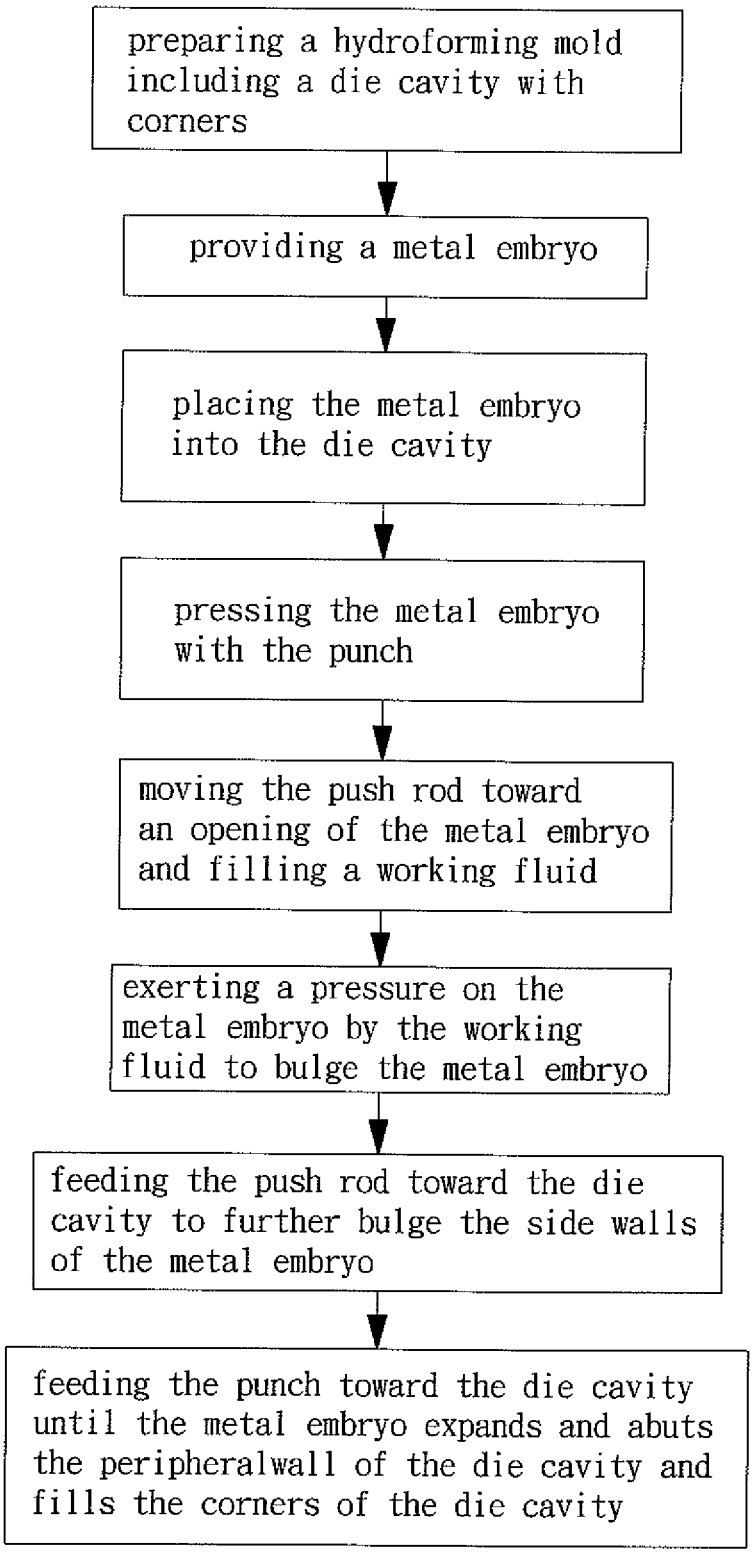
FIG. 1 is a flowchart showing a hydroforming method for metal according to the present invention.

A hydroforming method for metal according to the present invention is illustrated in the flowchart of FIG. 1. Please also refer to FIGS. 1-7. The steps of the hydroforming method for metal are set forth in detail hereinafter.

Figure 2:
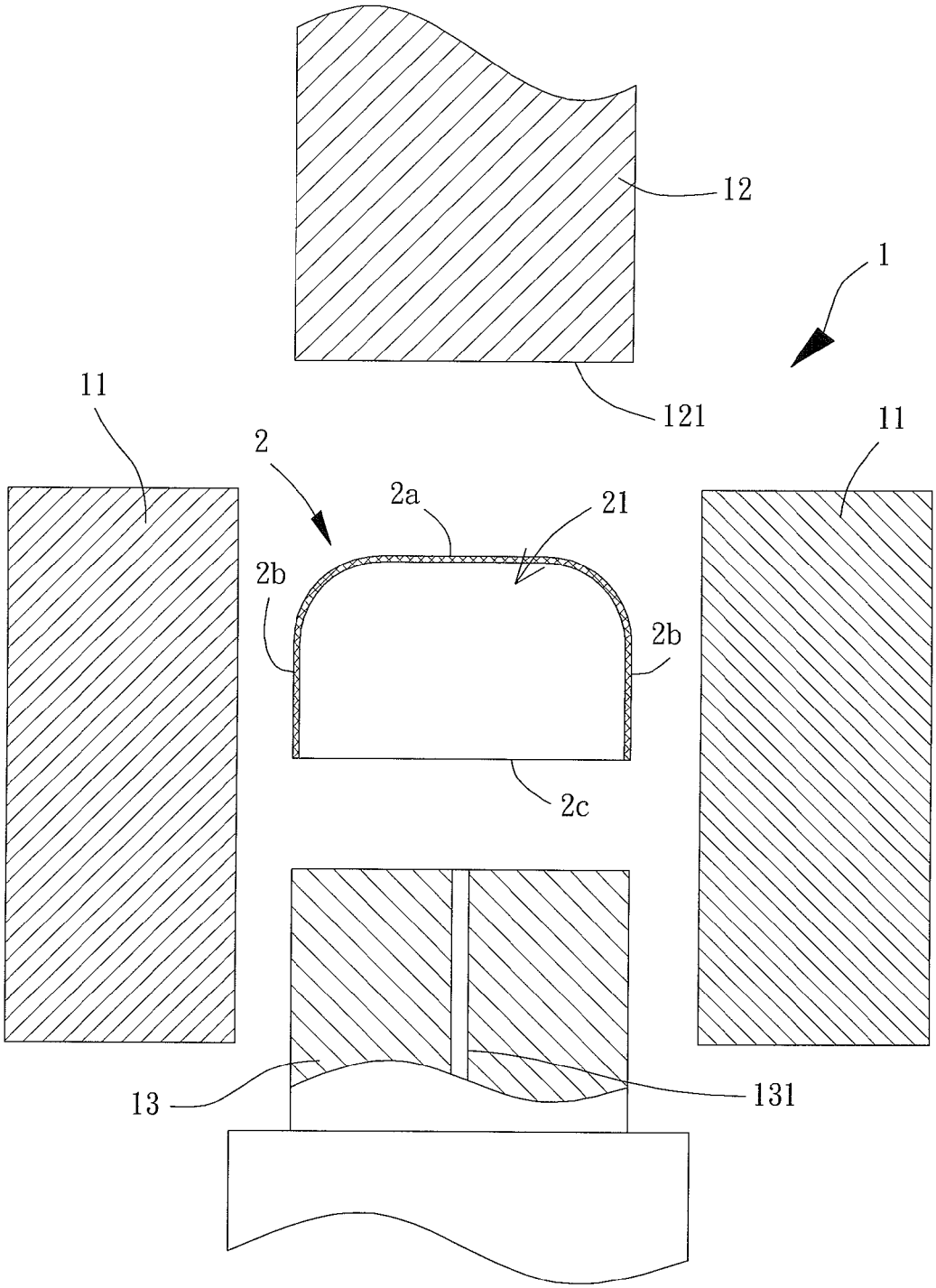
FIG. 2 is a schematic view of a first operational procedure of the hydroforming method for metal according to the present invention.
Figure 3:
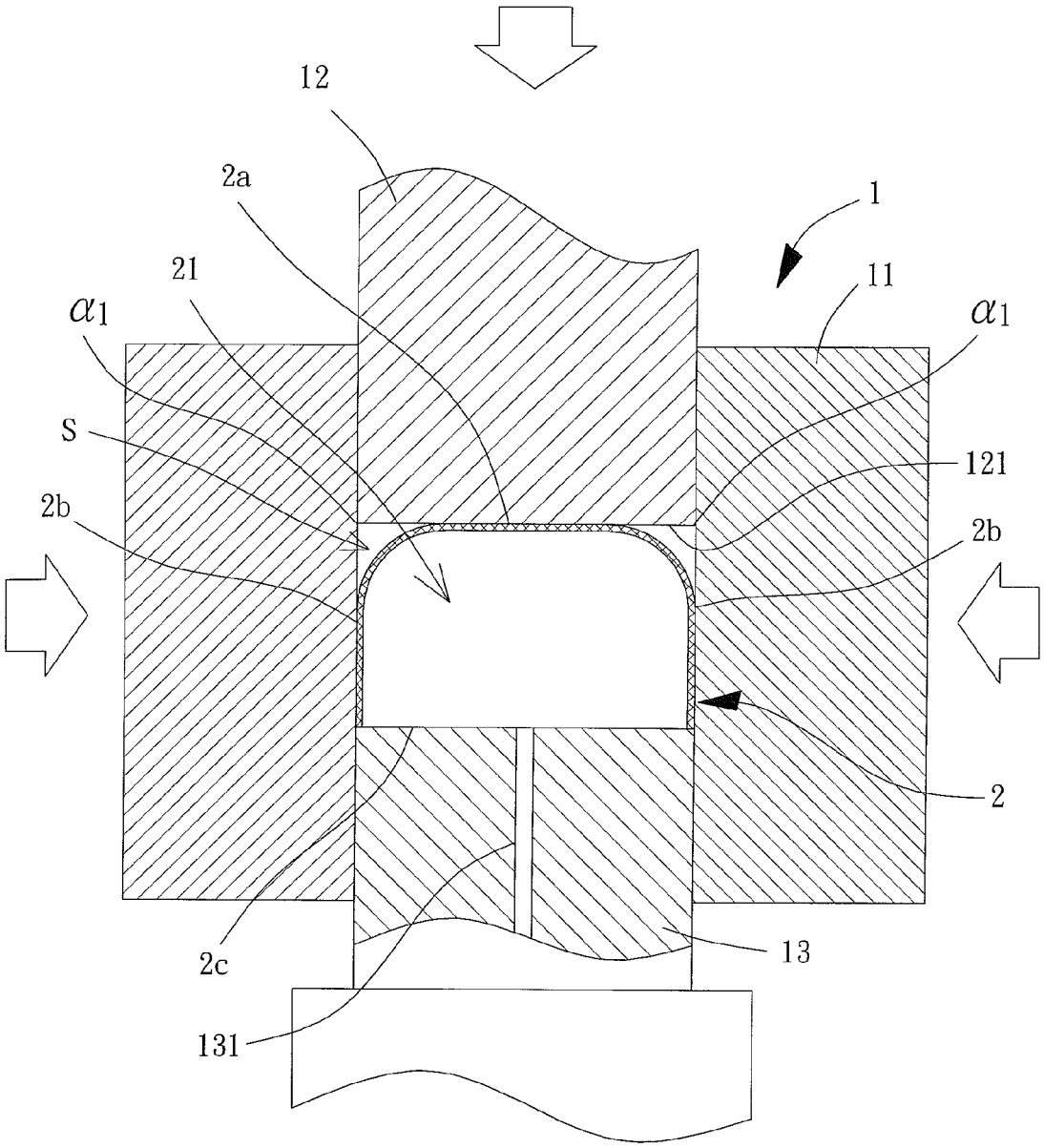
FIG. 3 is a schematic view of a second operational procedure of the hydroforming method for metal according to the present invention.

With reference to FIGS. 2 and 3, the first step includes preparing a hydroforming mold 1 and a metal embryo 2, and the metal embryo 2 is placed in a die cavity S of the hydroforming mold 1. Specifically, the hydroforming mold 1 can include two side dies 11, a punch 12, and a push rod 13, as shown in FIG. 2. The side dies 11, the punch 12, and the push rod 13 are moved to define the die cavity S (see FIG. 3). The die cavity S is used to receive the metal embryo 2. The side dies 11, the punch 12, and the push rod 13 can move toward the die cavity S for back and forth movement, and a peripheral wall of the die cavity S includes at least one corner $\alpha$1. The corner $\alpha$1 of the peripheral wall of the die cavity S can be formed by the side dies 11 and the punch 12. Furthermore, the corner α1 can be a right-angled corner of approximately 90 degrees.

Still referring to FIG. 3, the hydroforming mold 1 of this embodiment is generally used to form hardware of a non-rectangular shape. The peripheral wall of the die cavity S defined by the hydroforming mold 1 includes a plurality of first corners α1 (the opposite corners in the upper edge of the drawing), as shown in FIG. 3. Furthermore, the punch 12 includes a pressing face 121 facing the push rod 13. The push rod 13 includes a fluid injection channel 131 through which a working fluid is filled into the die cavity S.

Assemblage of the hydroforming mold 1 can be appreciated and carried out by one skilled in the art. The assembling procedures of the hydroforming mold 1 are not set forth to avoid redundancy.

With reference to FIGS. 2 and 3, the metal embryo 2 can be a cup-shaped metallic sheet metal shell having a circular, elliptic, rectangular, or polygonal shape. The metal embryo 2 in this embodiment has a cross sectional shape in the form of a hat. The metal embryo 2 is made of a ductile metal material. The metal embryo 2 includes a bottom 2*a*, a plurality of side walls 2*b*, and an opening 2*c*. The bottom 2*a* and the side walls 2*b* together define an interior space 21. The opening 2*c* is in communication with the interior space 21. In the next step, the metal embryo 2 is positioned in the die cavity S. In this embodiment, the bottom 2*a* of the metal embryo 2 is pressed by the pressing face 121 of the punch 12. The punch 12 can press against all or a portion of the bottom 2*a*. The opening 2*c* of the metal embryo 2 can face the push rod 13, such that the fluid injection channel 131 intercommunicates with the interior space 21 of the metal embryo 2.

Figure 4:
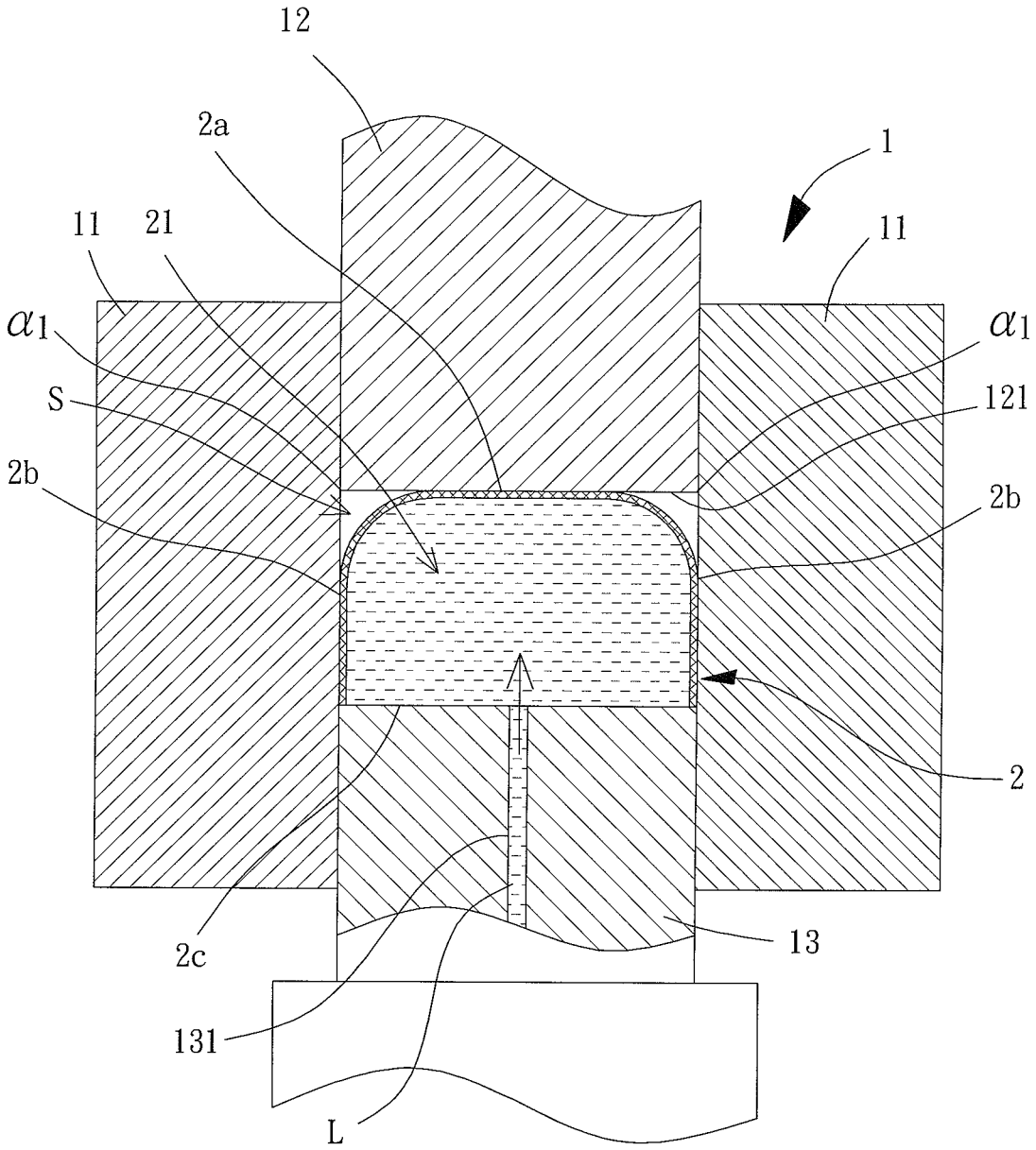
FIG. 4 is a schematic view of a third operational procedure of the hydroforming method for metal according to the present invention.
Figure 5:
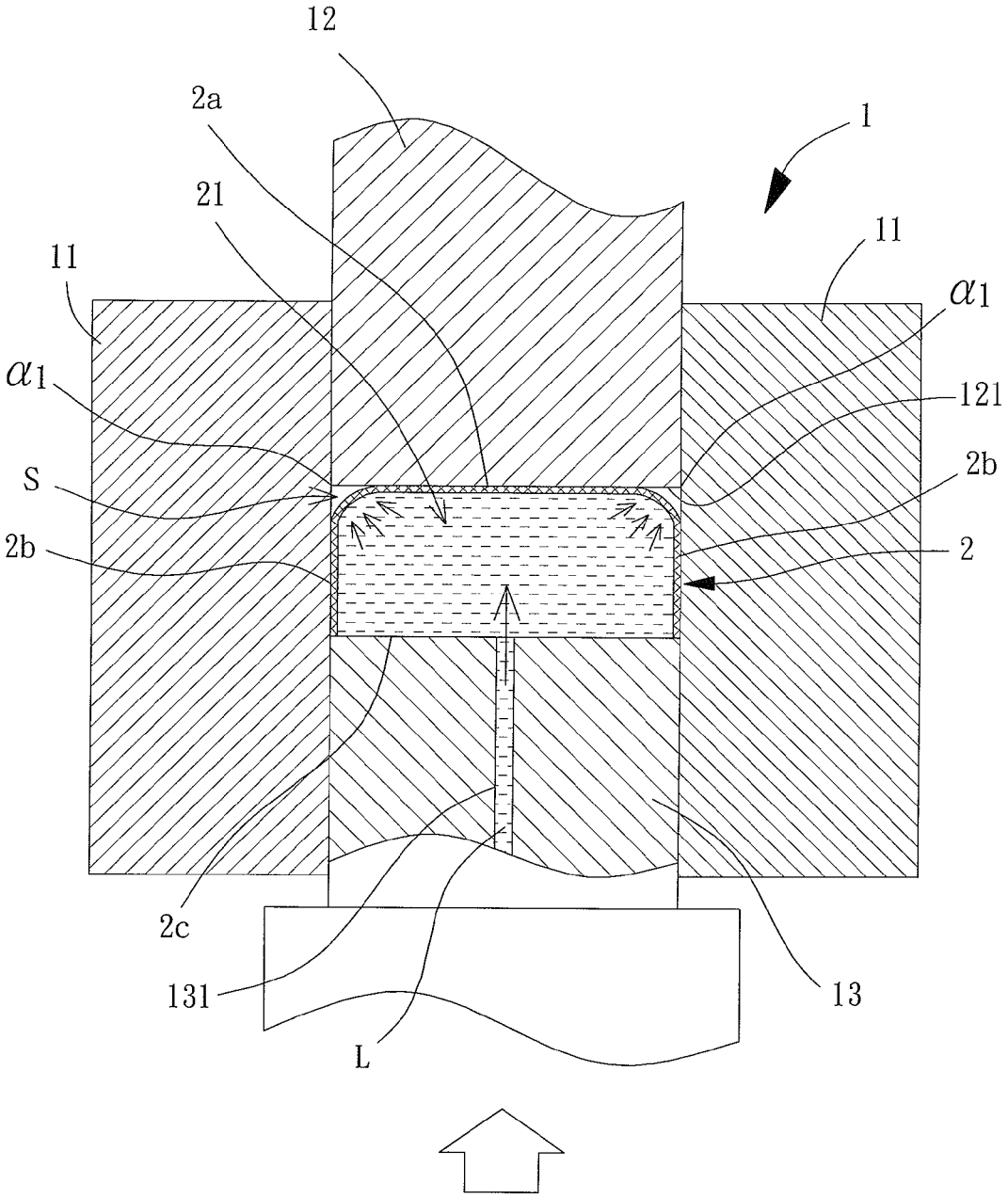
FIG. 5 is a schematic view of a fourth operational procedure of the hydroforming method for metal according to the present invention.

After the above first step, a second step is carried out, as shown in FIGS. 4 and 5. The second step includes filling the interior space 21 of the metal embryo 2 with a working fluid L, such that the working fluid L exerts a liquid pressure on the metal embryo 2, forcing the remaining side walls 2*b* and/or a portion of the bottom 2*a* not pressed by the punch 12 to expand outward. The working fluid L can continuously fill the interior space 21 via the opening 2*c* of the metal embryo 2, assuring that the working fluid L provides a continuous liquid pressure in the interior space 21.

With reference to FIG. 5, the push rod 13 of the hydroforming mold 1 can be moved toward the die cavity S, causing the push rod 13 to exert a pressure on the working fluid L, which, in turn, exerts top edges of the side walls 2*b* of the metal embryo 2 until the side walls 2*b* of the metal embryo 2 continuously bulge and fill the corners α1 of the die cavity S. Furthermore, after the working fluid L is filled into the interior space 21 of the metal embryo 2 and before the push rod 13 pushes the working fluid L toward the die cavity S, this embodiment further includes moving the punch 12 toward the die cavity S to press the metal embryo 2, such that the working fluid L can more easily press against the metal embryo 2 during subsequent push of the working fluid L by the push rod 13 toward the die cavity S, causing the metal embryo 2 to gradually bulge and approach the first corners α1 of the die cavity S.

Specifically, in this embodiment, the working fluid L is filled into the die cavity S via the fluid injection channel 131 and continuously fills the interior space 21 of the metal embryo 2 via the opening 2*c* of the metal embryo 2. Furthermore, while the working fluid L is continuously filled from the outside, the push rod 13 is moved in a direction indicated by an arrow in the drawing to compress the space of the die cavity S, and the side walls 2*b* of the metal embryo 2 can be used as the material supply. Under the continuous pressuring of the working fluid L, the metal embryo 2 can form pressures bulging toward the first corners α1 in a direction indicated by the arrows in the drawing, forcing the side walls 2*b* of the metal embryo 2 on the left and right sides of the drawing to gradually bulge and approach the first corners α1 of the die cavity S due to the material ductility.

Figure 6:
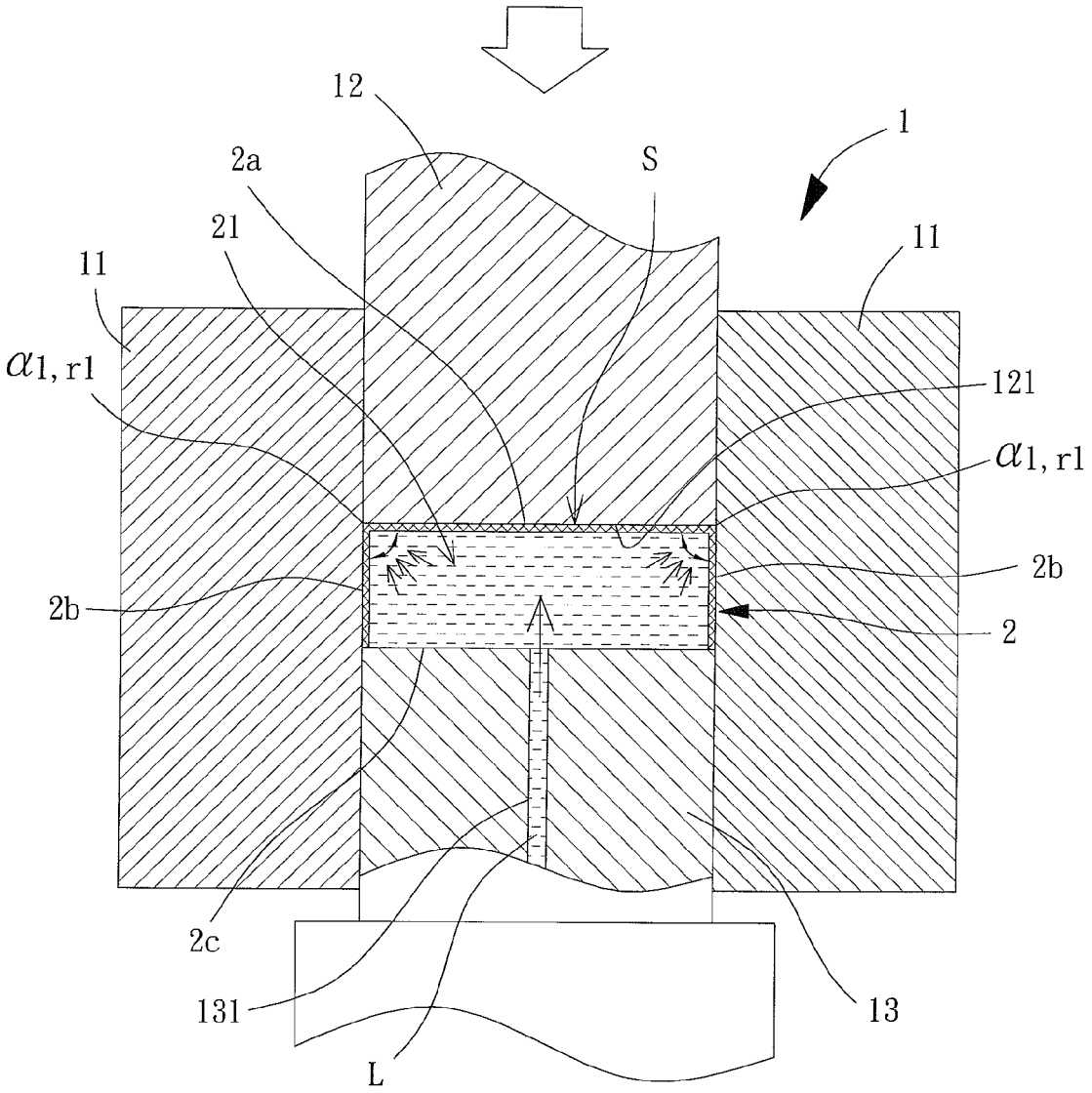
FIG. 6 is a schematic view of a fifth operational procedure of the hydroforming method for metal according to the present invention.

With reference to FIG. 6, to avoid excessive expansion of the metal embryo 2 under the liquid pressure, a third step of this embodiment is operating the punch 12 of the hydroforming mold 1, such that the punch 12 can be fed toward an interior of the die cavity S to press the metal embryo 2, causing the bottom 2*a* of the metal embryo 2 to deform and expand toward the peripheral wall of the die cavity S until it fills the first corners α1 formed by the peripheral wall of the die cavity S, forming a shaped metal blank. This step applies a downwardly pressing active force on the metal embryo 2 to force the first corners r1 of the metal embryo 2 at the upper part of the drawing to deform, bulge, and fill the first corners α1 of the die cavity S. Specifically, while continuously filling the working fluid L, by feeding the punch 12 to exert a downwardly pressing active force on the bottom 2*a* of the metal embryo 2 at the top part of the drawing, the upper edges (i.e., the corners r1 in the drawing) of the side walls 2*b* of the metal embryo 2 at the left and right sides of the drawing are forced to continuously deform and bulge in the direction indicated by the arrows in the drawing until the side walls 2*b* of the metal embryo 2 at the left and right sides of the drawing bulge and fill the first corners α1 of the die cavity S due to its material flow and ductility, such that the corners r1 having angles approximately the same as the first corners α1 of the die cavity S are formed on the upper edge of the metal embryo 2. Thus, under the cooperation of the liquid pressure and the downwardly pressing punch 12, the corners r1 of the metal embryo 2 of this embodiment at the upper part of the drawing can approximate right angles in cross section, as shown in the drawing.

Figure 7:
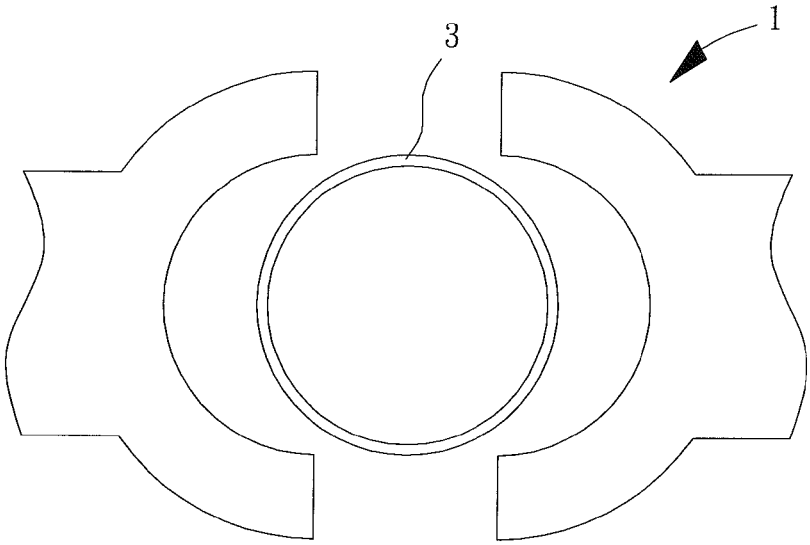
FIG. 7 is a schematic view of a sixth operational procedure of the hydroforming method for metal according to the present invention.

With reference to FIG. 7, hardware 3 (in the form of a circular cup in this embodiment) formed from the metal embryo 2 is obtained after the hydroforming mold 1 is removed. Hardware 3 of different shapes can be formed, such as cups having a circular, elliptic, rectangular, or polygonal shape, examples of which will be set forth in connection with the drawings.

Figure 8:
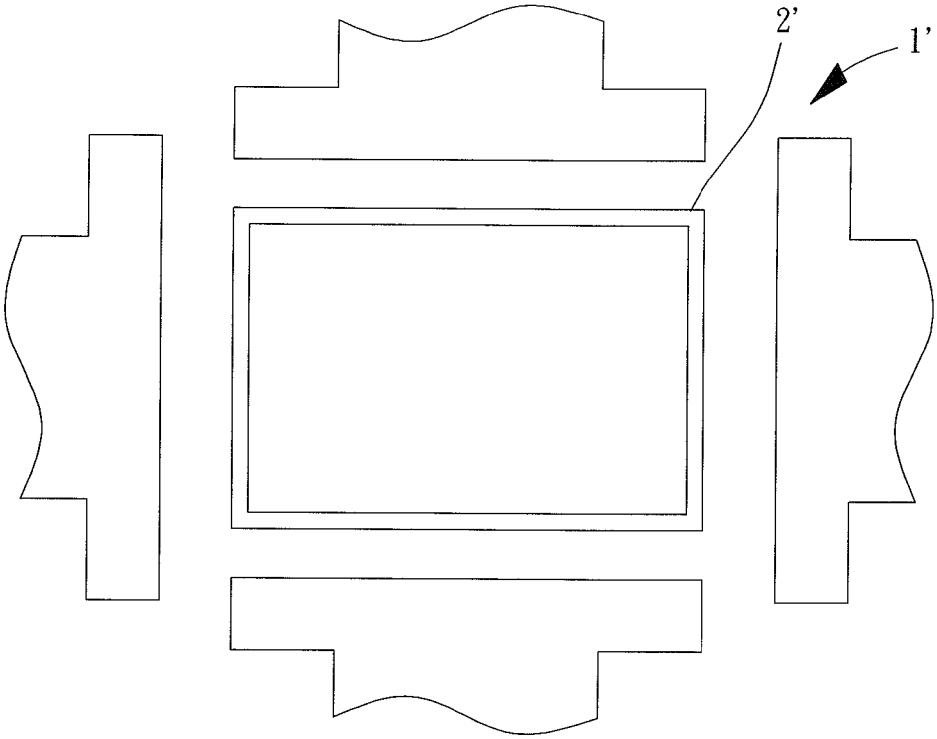
FIG. 8 is a schematic view of a mold for another example of the hydroforming method for metal according to the present invention.

Please further refer to FIG. 8 showing another preferred embodiment of the present invention. This embodiment uses a hydroforming mold 1' to cooperate a metal embryo 2' to produce a metal box based on the same technical concept. Please also refer to FIGS. 9-15. The steps are set forth in detail hereinafter.

Figure 9:
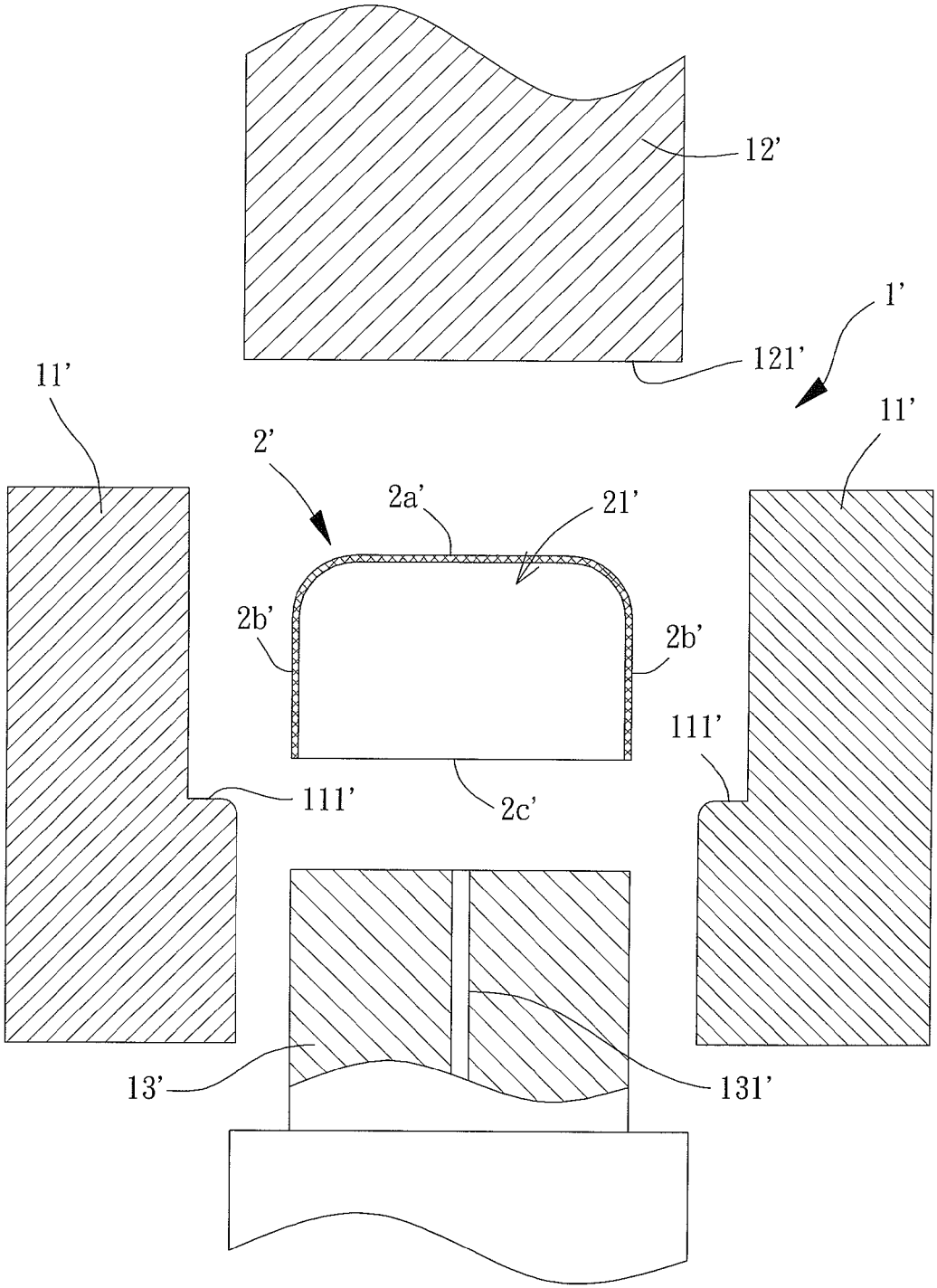
FIG. 9 is a schematic view of an operational procedure of another example of the hydroforming method for metal according to the present invention.
Figure 10:
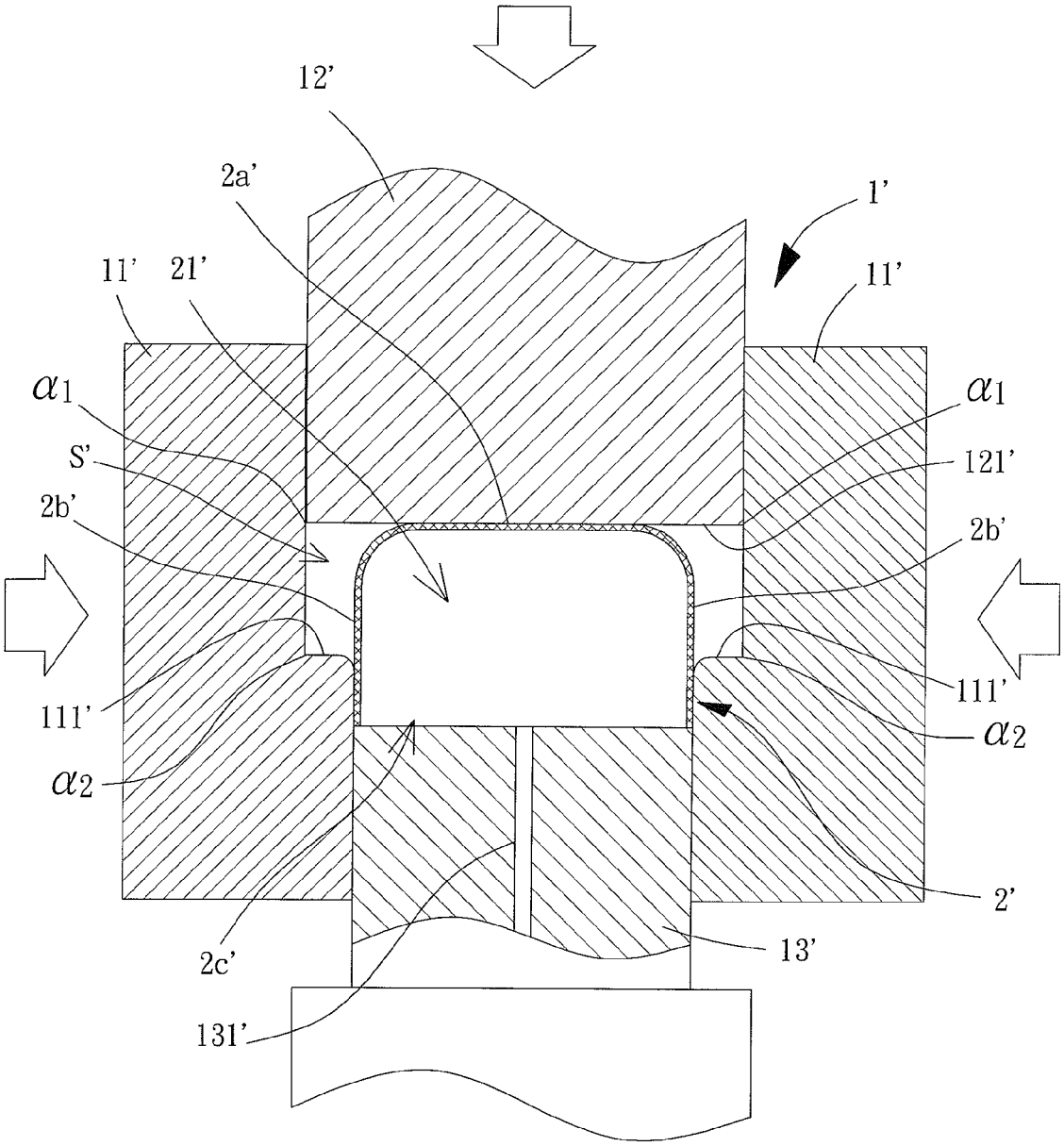
FIG. 10 is a schematic view of an operational procedure of another example of the hydroforming method for metal according to the present invention.

With reference to FIG. 9, the hydroforming mold 1' can include two opposite side dies 11', a punch 12', and a push rod 13' having a fluid injection channel 131'. In addition to the first corners α1 of the peripheral wall of the die cavity S' formed by the side dies 11' and the punch 12' identical to the above embodiment, the hydroforming method 1' is different from the above embodiment by that a shoulder 111' extends from a portion of each side die 11' of the hydroforming mold 1' adjacent to the push rod 13. Other corners of the peripheral wall of the die cavity S' can be formed by the shoulders 111'. Thus, the peripheral wall of the die cavity S' defined by the hydroforming mold 1' include an approximately right-angled first corner α1 and approximately right-angled second corners α2, as shown in FIG. 10 (the opposite wall corners at the upper and lower edges of the drawing).

Figure 11:
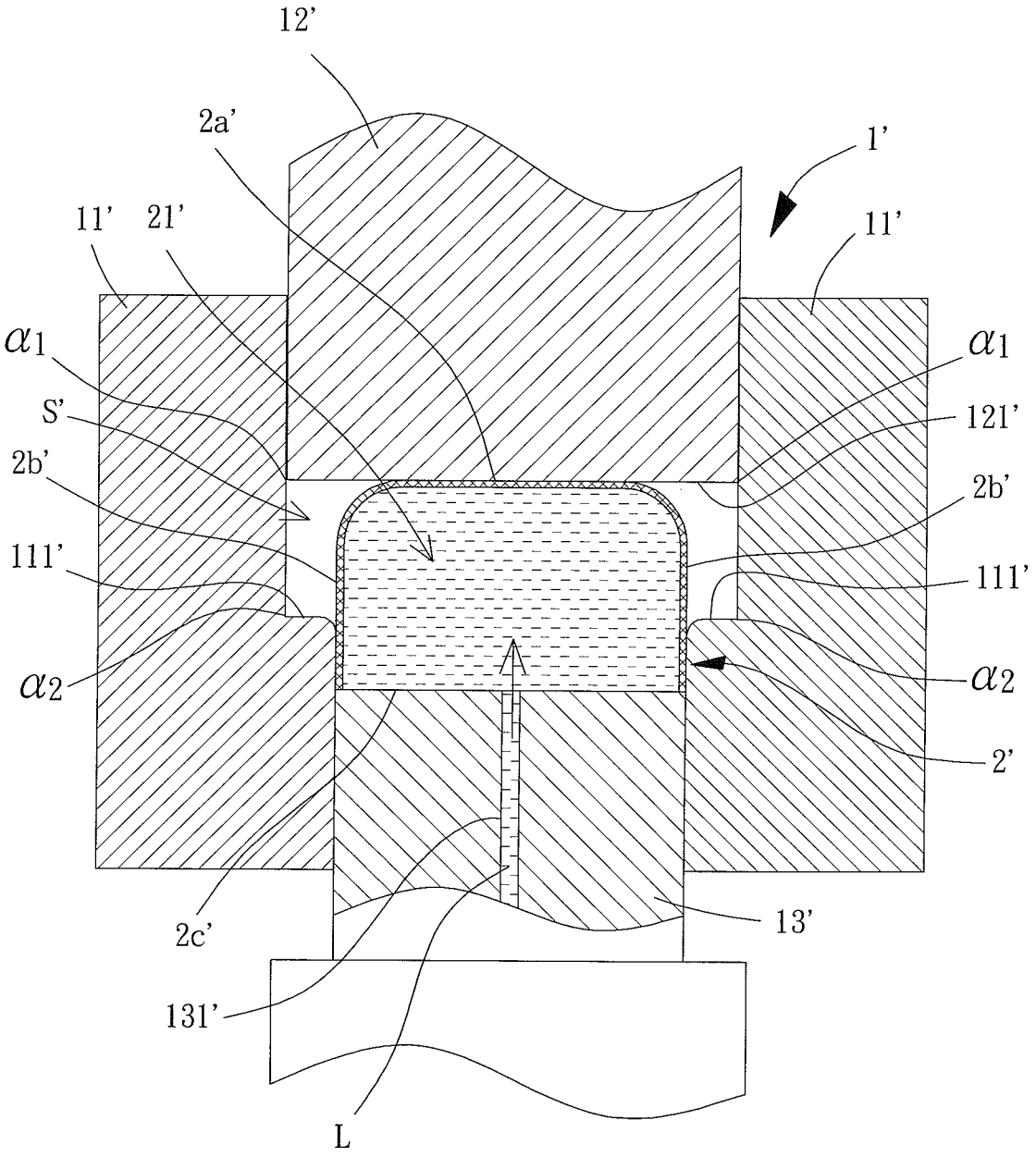
FIG. 11 is a schematic view of an operational procedure of another example of the hydroforming method for metal according to the present invention.
Figure 12:
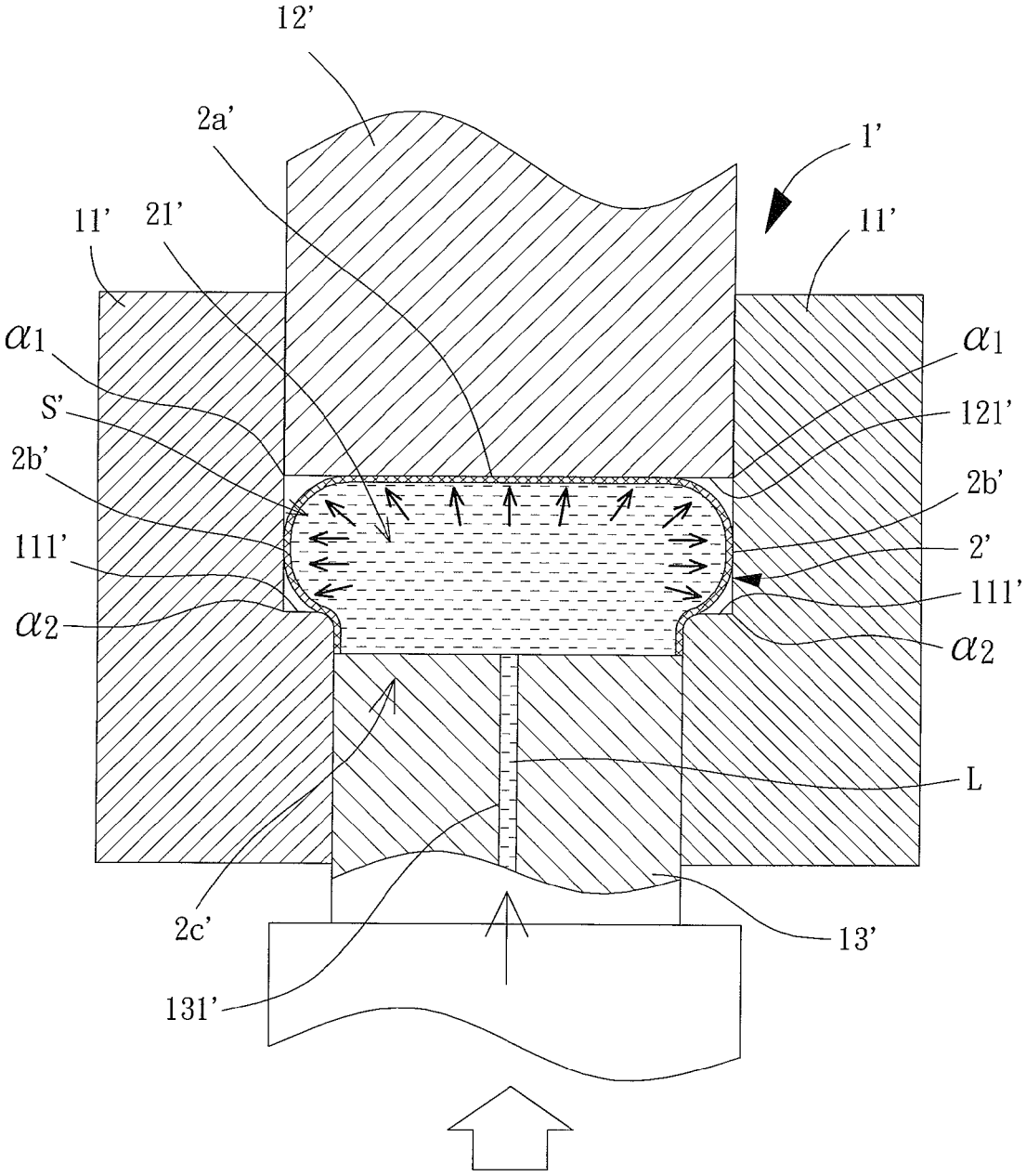
FIG. 12 is a schematic view of an operational procedure of another example of the hydroforming method for metal according to the present invention.

Similar to the above embodiment, this embodiment also firstly places the meal embryo 2' in the die cavity S', with the punch 12' pressing against the bottom 2*a*', and with the push rod 13' facing the opening 2*c*'. Then, the working fluid L is filled into the interior space 21' of the metal embryo 2', and a continuous liquid pressure is provided by continuously filling the working fluid L into the metal embryo 2', as shown in FIG. 11. Next, the push rod 13' of the hydroforming mold 1' is fed toward an interior of the die cavity S', such that the push rod 13' exerts a pressure to the working fluid L and top edges of the side walls 2*b*' of the metal embryo 2', as shown in FIG. 12. Thus, the side walls 2*b*' of the metal embryo 2' expand and continuously bulge to press against the walls of the two opposite side dies 11' of the hydroforming mold 1'.

With reference to FIG. 12, this embodiment can also use the side walls 2*b*' of the metal embryo 2' as the material supply to force, such that when metal embryo 2' is subjected to leftward and rightward expanding pressures indicated by the arrows in the drawing, the side walls 2*b*' at the left and right sides of the metal embryo 2' gradually bulge and expand due to its material ductility until the side walls 2*b*' become arcuate and contact the peripheral wall of the die cavity S'.

In addition to maintaining the above-mentioned feeding of the push rod 13' toward the interior of the die cavity S', this embodiment can also slightly move the punch 12' away from the die cavity S' (not shown) to slightly enlarge the space of the die cavity S', forcing the bottom 2*a*' of the metal embryo 2' to bulge and expand into an arcuate shape until it presses against the pressing face 121' of the punch 12', and the side walls 2*b*'can simultaneously bulge and expand into an arcuate shape until the side walls 2*b*' press against the two opposite side dies 11', thereby enhancing the material supply effect. When the push rod 13' moves toward the die cavity S' while the punch 12' is moving away from the die cavity S', the velocity of the punch 12' is preferably smaller than the velocity of the push rod 13' moving toward the die cavity S'.

Figure 13:
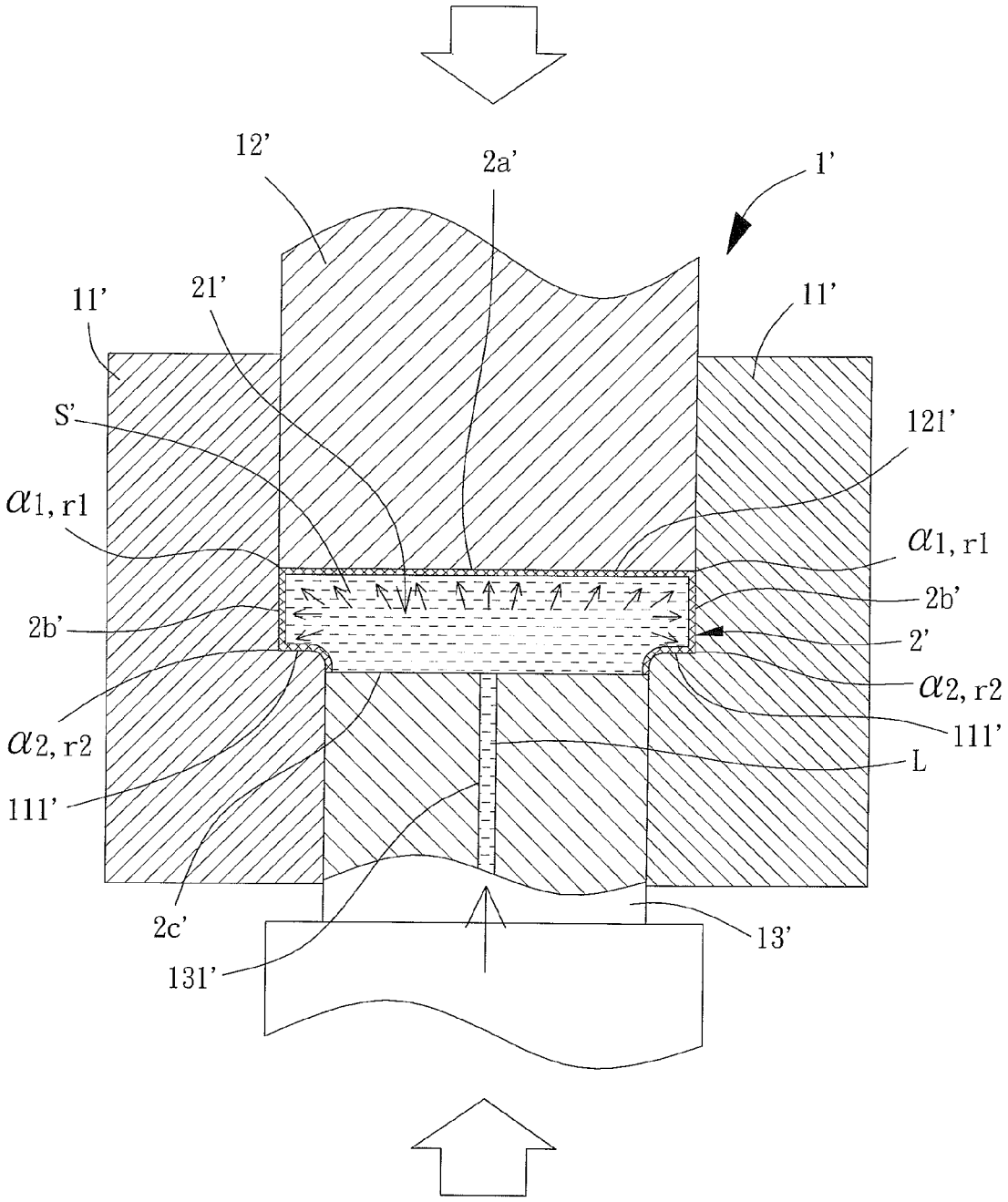
FIG. 13 is a schematic view of an operational procedure of another example of the hydro forming method for metal according to the present invention.

Next, with reference to FIG. 13, the punch 12' of the hydroforming mold 1' also exerts a downwardly pressing active force on the metal embryo 2' to cause each corner of the metal embryo 2' (the corners r1 at the upper part of the drawing and the corners r2 at the lower part of the drawing) to deform and bulge toward the peripheral wall of the die cavity S' and respectively fill the first corners α1 and the second corners α2 of the die cavity S'. Namely, the upper and lower edges of the side walls 2*b*' on the left and right sides of the metal embryo 2' (i.e., the corners r1 and r2 in the drawing) can continuously deform and bulge in a direction indicated by the arrows in the drawing until they bulge and fill the first corners α1 and the second corners α2 of the die cavity S', such that corners r1 and r2 having angles approximately the same as the first corners α1 and the second corners α2 of the die cavity S are formed on the upper and lower edges of the metal embryo 2. The corners r1 and r2 can approximate right angles, as shown in the drawing.

Figure 14:
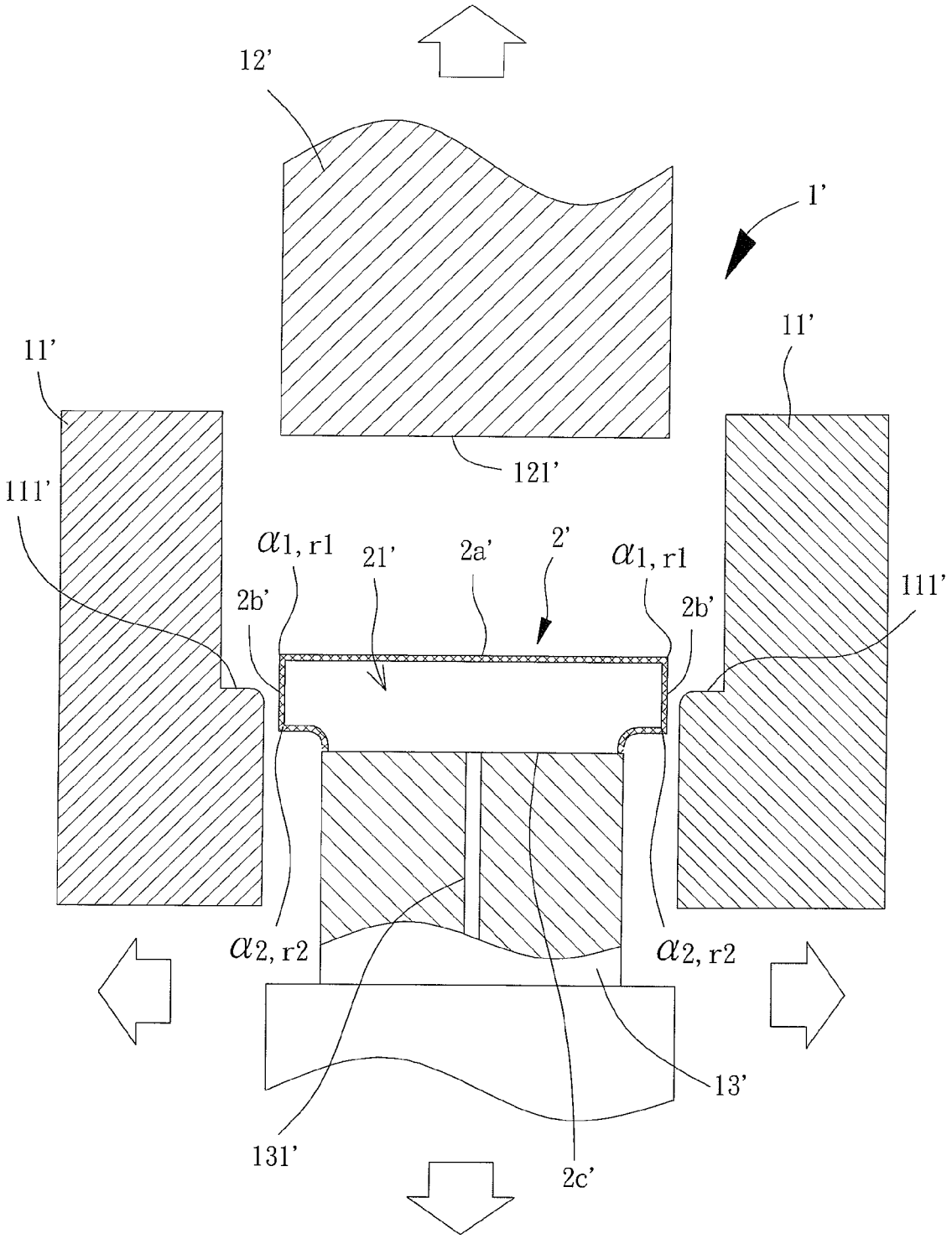
FIG. 14 is a schematic view of an operational procedure of another example of the hydroforming method for metal according to the present invention.
Figure 15A:
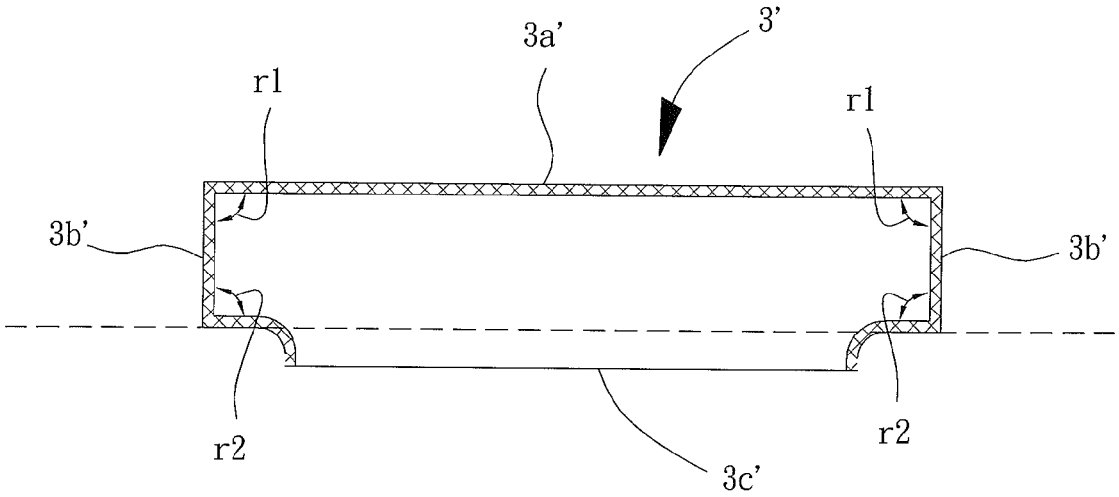
FIGS. 15*a* and 15*b* are schematic views of an operational procedure of another example of the hydroforming method for metal according to the present invention.
Figure 15B:
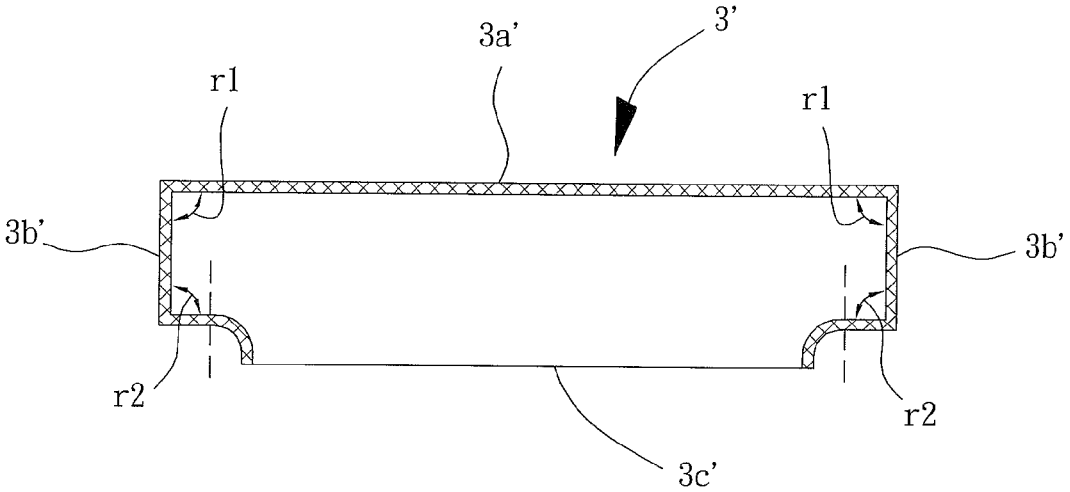

As can be seen from FIG. 14, hardware 3' formed from the metal embryo 2' is obtained after removing the hydroforming mold 1'. The hardware shown in the drawing is a box-shaped body (hereinafter referred to as "metal box 3'", see FIGS. 15*a* and 15*b*). The metal box 3' includes a bottom wall 3*a*', a plurality of side walls 3*b*', and an opening 3*c*'. As can be seen from FIG. 15*b*, the metal box 3' can be cut after formation of the metal box 3' to remove redundant material at the opening 3*c*' of the metal box 3', finely producing the metal box 3' after trimming. The angle in cross section of each corner r1, r2 of the metal box 3' in this embodiment can approximate a right angle, as shown in the drawing.

After formation, the maximum inner radius of each corner r1, r2 at the upper and lower edges of the metal box is 1.7 mm when a thickness of the sheet metal of the metal box 3' at the first corner r1 or the second corner r2 of the die cavity S' is 1.5 mm.

Figure 16:
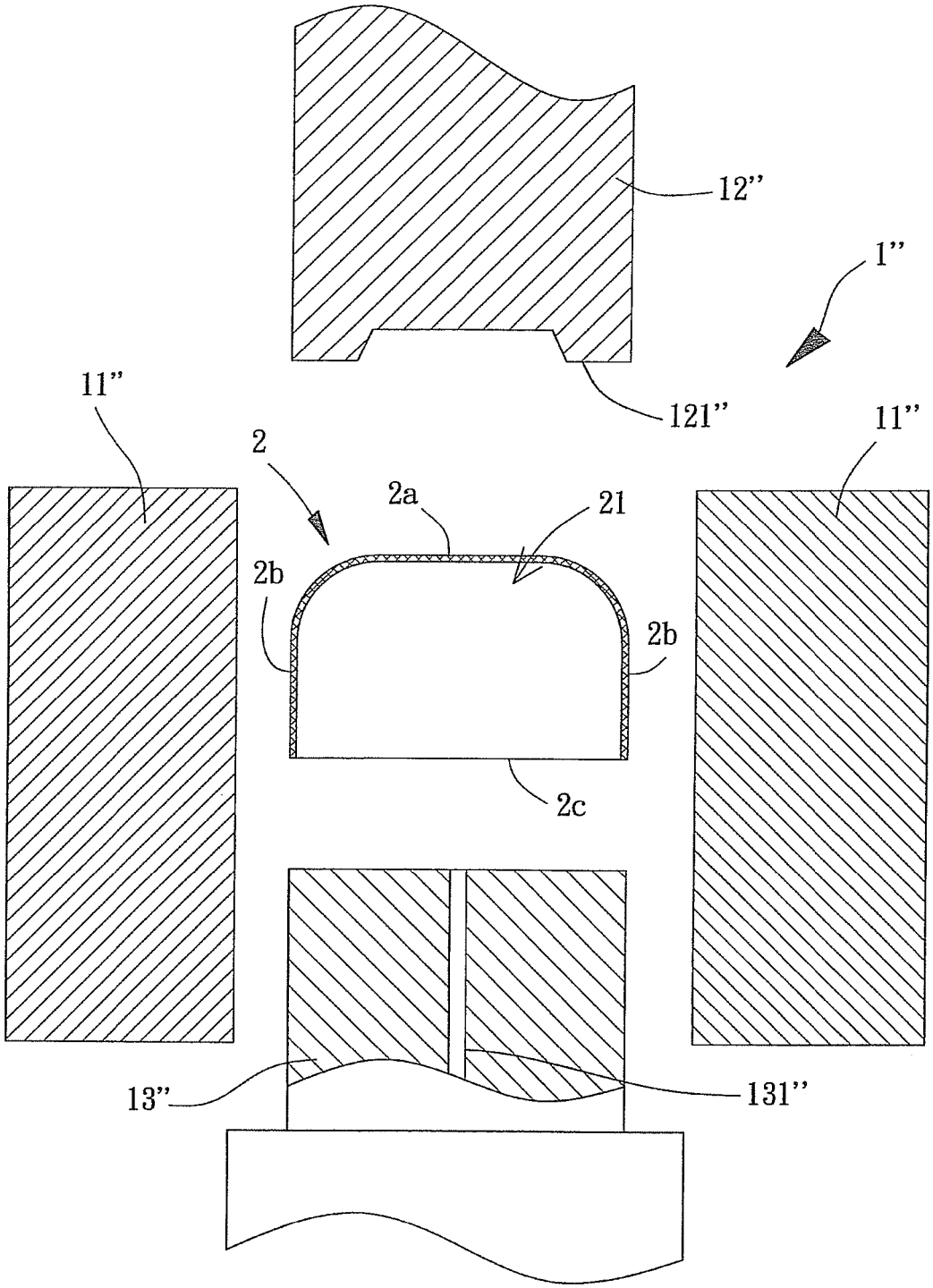
FIG. 16 is a schematic exploded view of a further example of the hydroforming method for metal according to the present invention.
Figure 17:
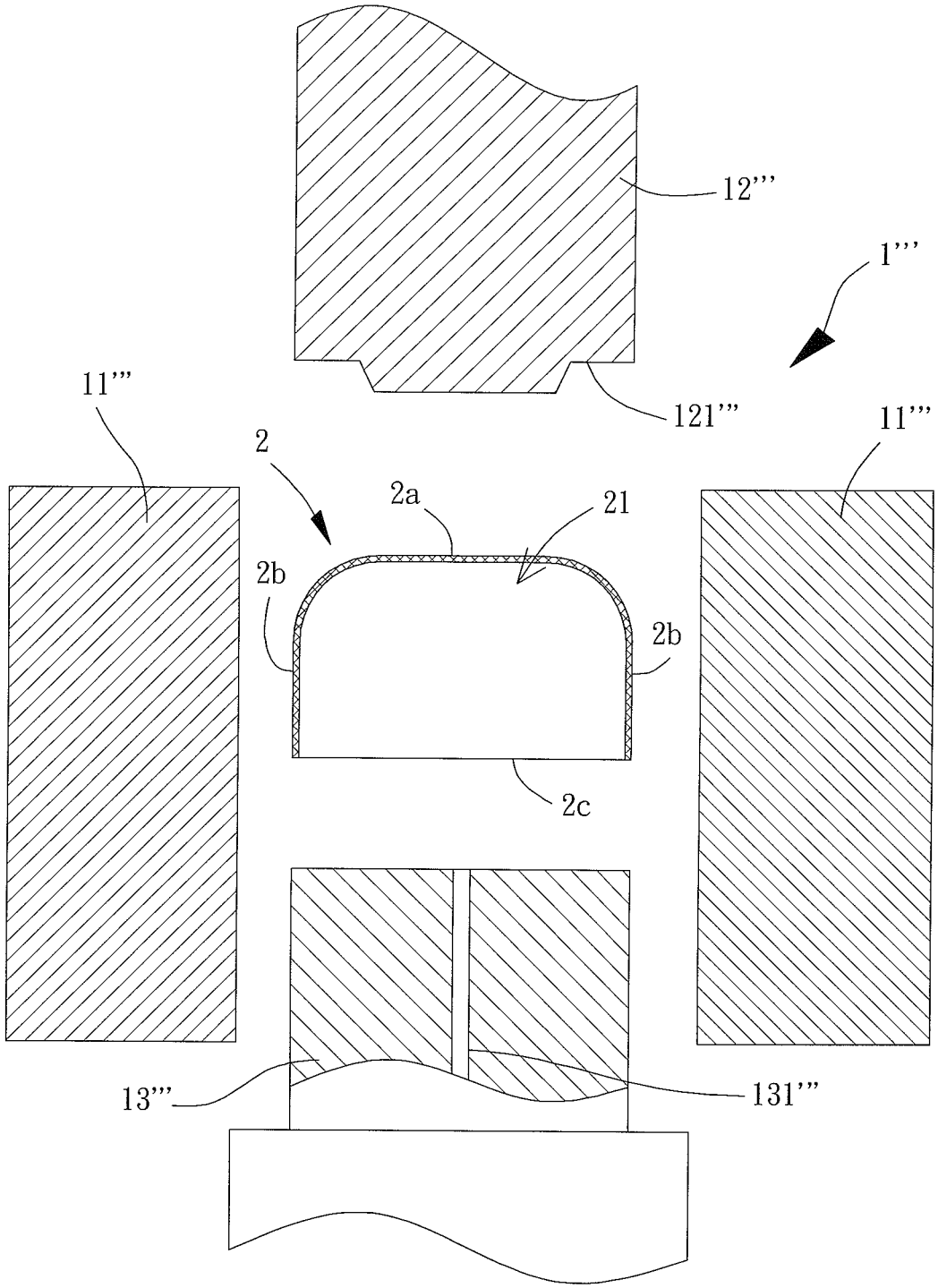
FIG. 17 is a schematic exploded view of still another example of the hydroforming method for metal according to the present invention.

With reference to FIGS. 16 and 17, according to different shapes of objects to be formed, a corresponding hydroforming mold 1" can be used to liquid-press the metal embryo, such that the shape of the metal embryo is substantially the same as that of the die cavity defined by the side dies, the punch, and the push rod.The hydroforming mold 1" can include two opposite side dies 11", a punch 12" having a pressing face 121", and a push rod 13" having a fluid injection channel 131". As can be seen from the drawings, based on the same technical concept as the above embodiments, hydroforming molds 1" and 1'" of other types can be used to liquid-press the metal embryo into hardware with specific outlines, the steps of which are not described to avoid redundancy.

Based on the above concept, responsive to a different hydroforming mold 1, a person having ordinary skill in the art of the invention could provide active forces in other directions to the metal blank by other components according to the structure of the hydroforming mold 1. As an example, the push rod 13, 13' or one of the side dies 11, 11' is selectively moved to operate technical means in the manufacturing procedures, such as repeated feeding and retraction, producing hardware of different specifications but having the same specific angle.

In view of the foregoing, the main features of the hydroforming method for metal according to the present invention are that by using the working fluid L to provide a liquid pressure on the metal embryo 2' and cooperating with the push rod 13, 13' of the hydroforming mold 1, 1' to supply material from the lower edge, the side walls 2*b*, 2*b*' can be forced to bulge. Furthermore, by using the hydroforming mold 1, 1' to provide a downwardly pressing active force on the bottom 2*a*, 2*a*' of the metal embryo 2, 2', under feeding of the downwardly pressing active force cooperating with continuous liquid pressure, the metal embryo 2, 2' deforms and bulges until each corner of the metal embryo 2, 2' (the corners r1 and r2 in cross section in the drawing) and the wall corners (the first corners α1 and the second corners α2) of the die cavity S, S' of the hydroforming mold 1, 1' have approximately the same angles. Hardware, every angle of which approximates a right angle, can be obtained after removing the hydroforming mold.

A hydroforming method for a metal box according to the present invention is shown in FIGS. 18-24. The hydroforming method for a metal box includes the following steps.

Figure 18:
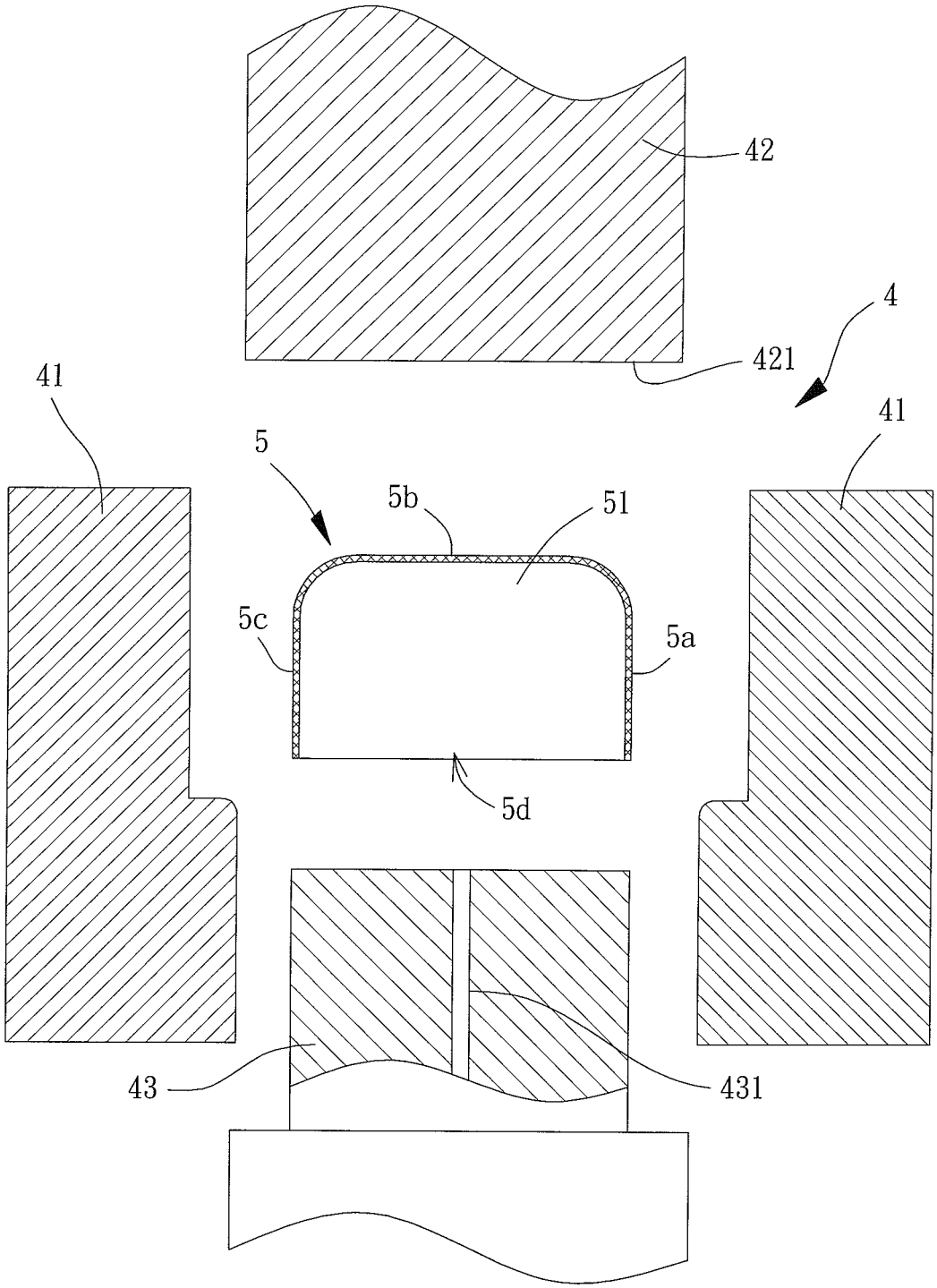
FIG. 18 is a schematic view of a first operational procedure of a hydroforming method for making a metal box according to the present invention.
Figure 19:
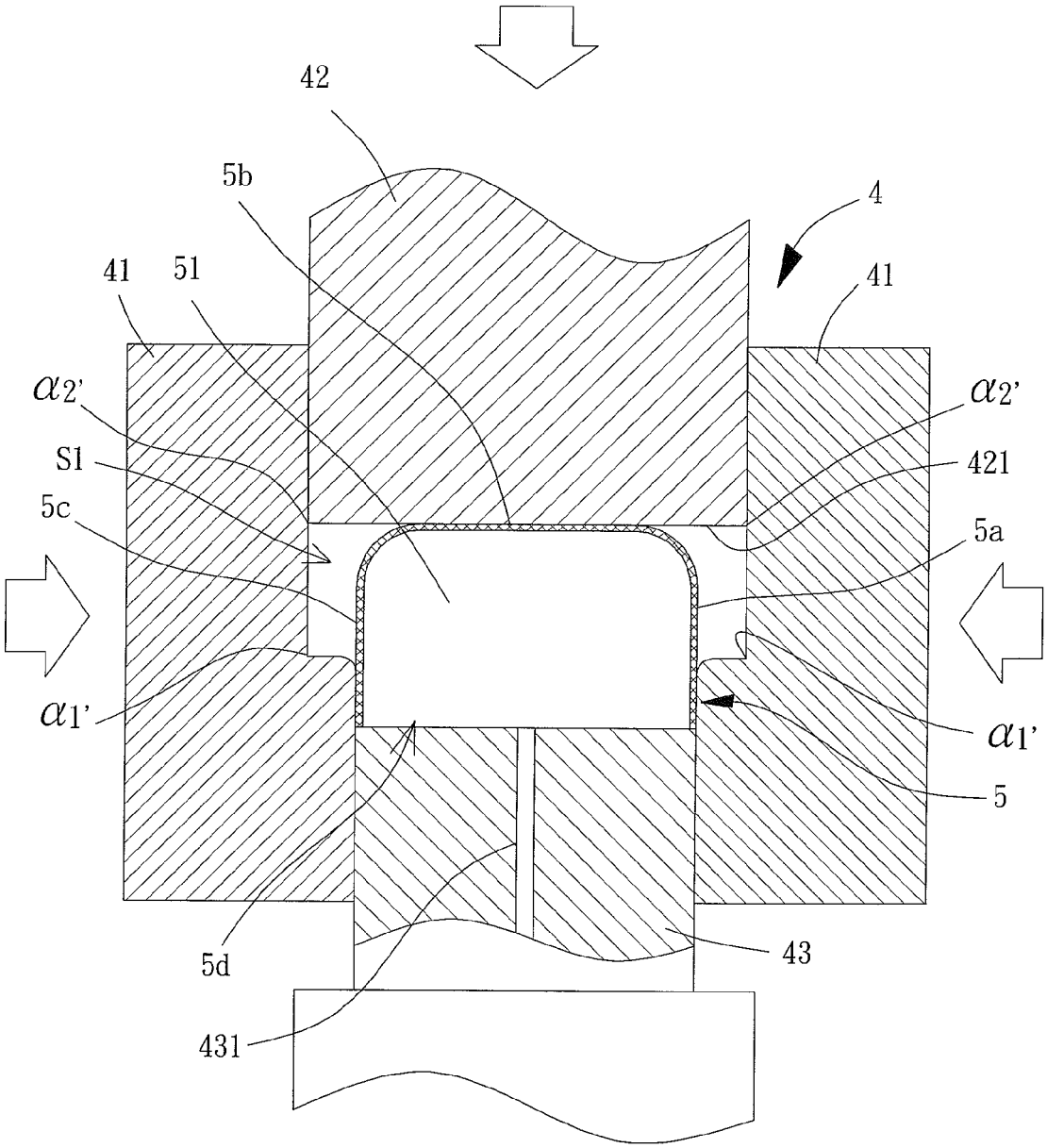
FIG. 19 is a schematic view of a second operational procedure of the hydroforming method for making a metal box according to the present invention.

With reference to FIGS. 18 and 19, the first step includes preparing a hydroforming mold 4 and a metal box embryo 5, and placing the metal box embryo 5 into a die cavity S1 of the hydroforming mold 4. Specifically, the hydroforming mold 4 can include two opposite side dies 41, a punch 42, and a push rod 43 to define the die cavity S1, and the die cavity S1 is used to receive the metal box embryo 5, as shown in FIG. 18. The two opposite side dies 41, the punch 42, and the push rod 43 can move toward the die cavity S1 for back and forth movement. In this embodiment, the peripheral wall of the die cavity S1 includes a set of lower edge wall corners α1' approximating a right angle and a set of upper edge wall corners α2' approximating a right angle, as shown in the drawing. Furthermore, the punch 42 includes a pressing face 421 facing the push rod 43. The push rod 43 includes a fluid injection channel 431 through which a working fluid is filled.

Assemblage of the hydroforming mold 4 can be appreciated and carried out by one skilled in the art and is not set forth herein to avoid redundancy.

In continuation to the above, the metal box embryo 5 of this embodiment can be a hat-shaped sheet metal shell, as shown in FIGS. 18 and 19. The metal box embryo 5 is made of a ductile metal material. The metal box embryo 5 includes a plurality of sheet metals (see 5*a*, 5*b*, and 5*c* in the cross-sectional view shown) and an opening 5*d*, as shown in the drawing. The sheet metals together define an interior space 51. The opening 5*d* is in communication with the interior space 51. In the next step, positioning of the metal box embryo 5 in the die cavity S1 is firstly assured, and one of the sheet metals (i.e., the sheet metal 5*b* in the drawing, hereinafter referred to as "top sheet metal 5*b*") of the metal box embryo 5 is pressed by the pressing face 421 of the punch 42. Furthermore, the opening 5*d* of the metal box embryo 5 faces the push rod 43, such that the fluid injection channel 431 of the push rod 43 intercommunicates with the interior space 51 of the metal box embryo 5, constructing a working module shown in FIG. 19.

Figure 20:
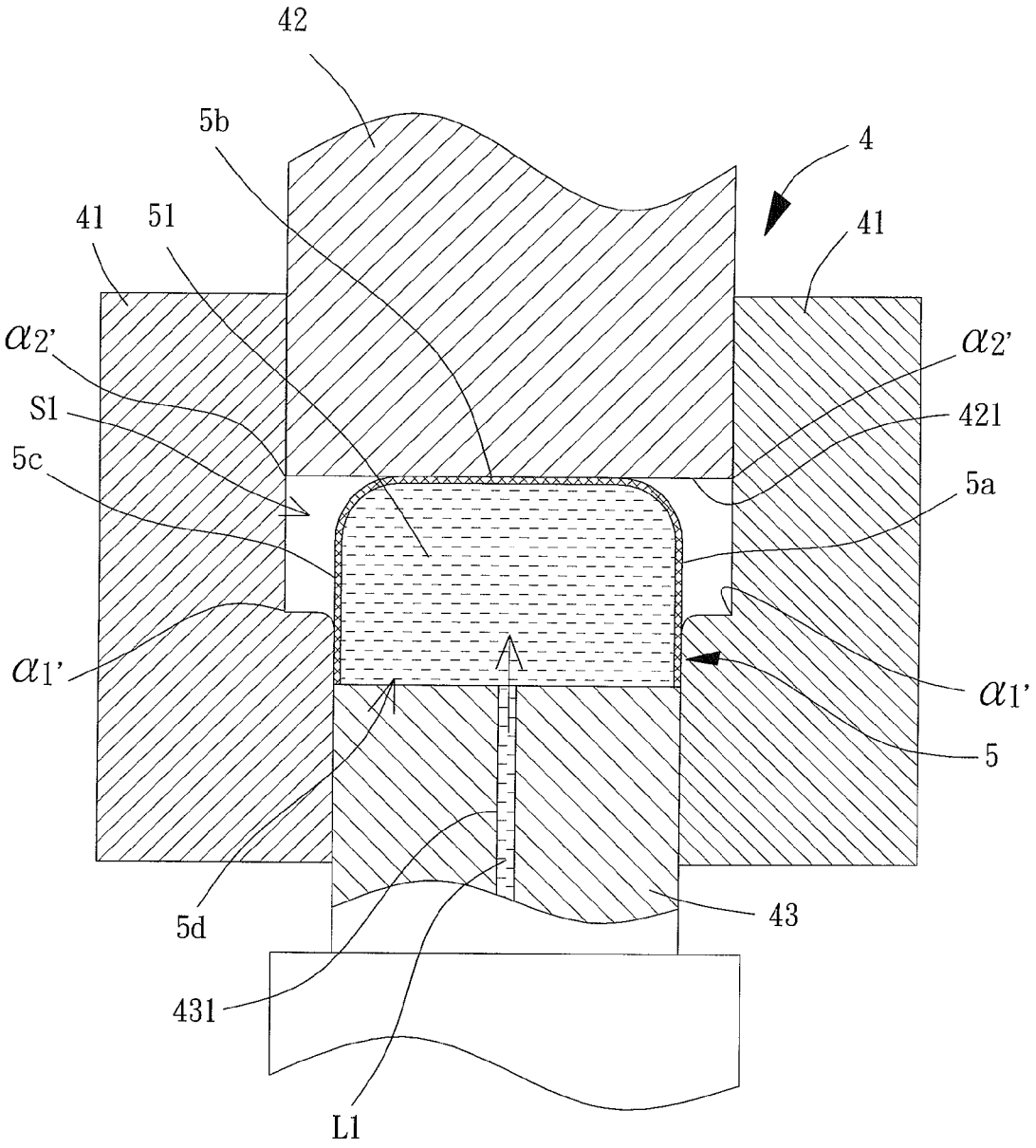
FIG. 20 is a schematic view of a third operational procedure of the hydroforming method for making a metal box according to the present invention.
Figure 21:
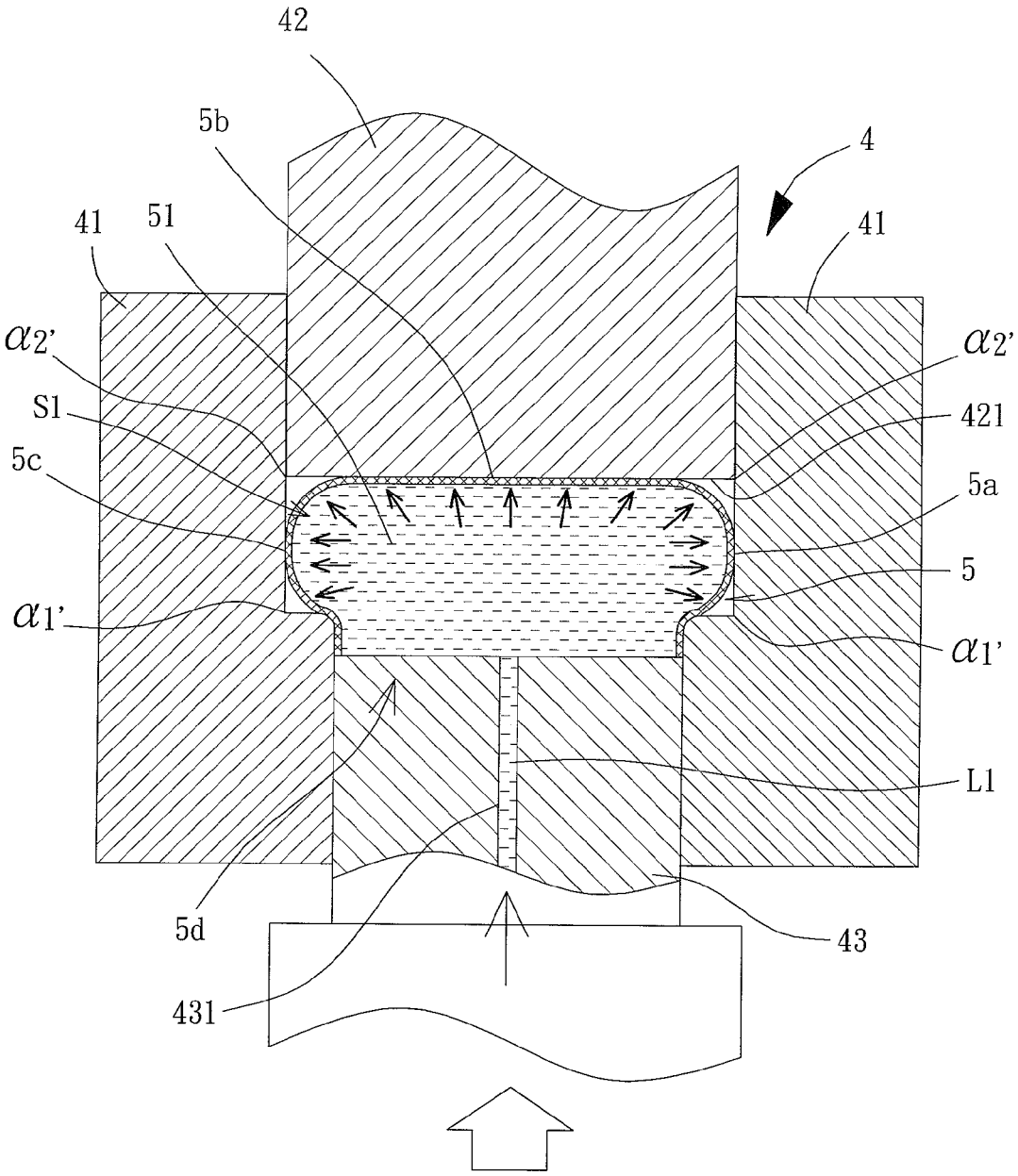
FIG. 21 is a schematic view of a fourth operational procedure of the hydroforming method for making a metal box according to the present invention.

After the above first step, a second step is carried out, as shown in FIGS. 20 and 21. The second step includes filling the interior space 51 with a working fluid L1 of the metal box embryo 5, such that the working fluid Li exerts a liquid pressure on the metal box embryo 5, forcing the remaining sheet metals to bulge outward. With reference to FIG. 21, the push rod 43 of the hydroforming mold 4 is fed toward the die cavity S1 until the remaining sheet metals (i.e., the sheet metals 5*a*, 5*c*, hereinafter referred to as "side sheet metals 5*a*, 5*c*") of the metal box embryo 5 continuously bulge into the die cavity S1 and gradually press against the peripheral wall (i.e., the two opposite side dies forming the die cavity S) of the die cavity S.

Specifically, in this embodiment, the working fluid L1 is filled into the die cavity S1 via the fluid injection channel 431 and continuously fills the interior space 51 of the metal box embryo 5 via the opening 5*d* of the metal box embryo 5. Furthermore, while the working fluid L1 is continuously filled from the outside, the push rod 43 is moved in a direction indicated by the arrow in the drawing and is fed in the die cavity S1, and a portion of the metal box embryo 5 adjacent to the push rod 43 can be used as material supply. While the metal box embryo 5 is subjected to leftward and rightward expanding pressures indicated by the arrows in the drawing, the side sheet metals 5*a* and 5*c* of the metal box embryo 5 on the left and right parts of the drawing gradually bulge due to its material ductility until the side sheet metals 5*a* and 5*c* become arcuate and abut the peripheral wall of the die cavity S (the left and right walls shown in cross section in the drawing).

In addition to maintaining the above movement, the punch 42 can be moved away from the die cavity S1 (not shown) to slightly enlarge the interior space 51 of the die cavity S1, forcing the top sheet metal 5*b* at the top portion of the metal box embryo 5 to bulge and expand into an arcuate shape until it presses against the pressing face 421 of the punch 42, and the side sheet metals 5*a* and 5*c* can simultaneously bulge and expand into an arcuate shape until they press against the two opposite side dies 41, thereby enhancing the material supply effect.

Figure 22:
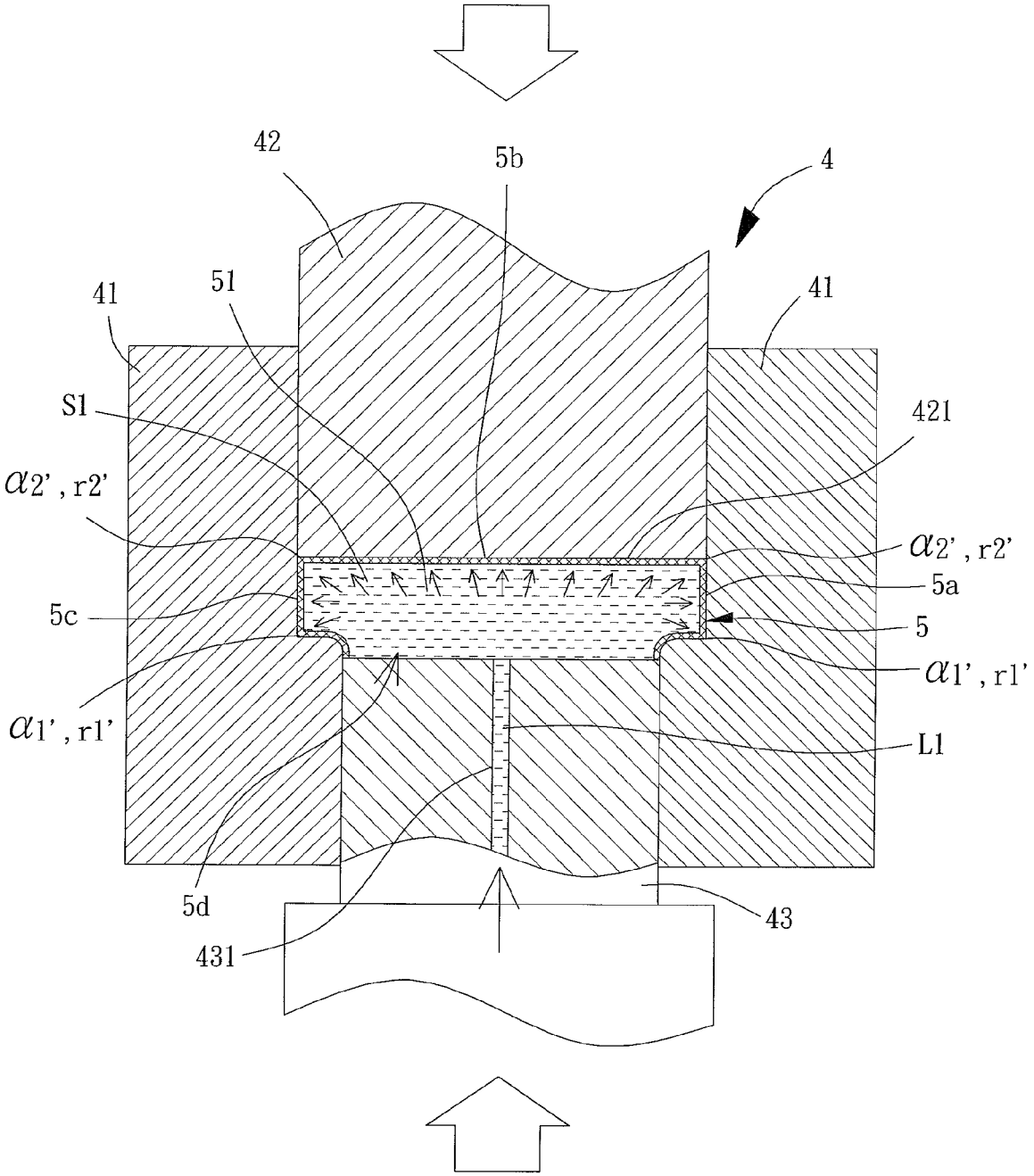
FIG. 22 is a schematic view of a fifth operational procedure of the hydroforming method for making a metal box according to the present invention.

To avoid excessive expansion of the metal box embryo 5 under the liquid pressure, a third step is carried out, as shown in FIG. 22. This step is operating the punch 42 of the hydroforming mold 4, such that the punch 42 can be fed toward an interior of the die cavity S1 to press the metal box embryo 5, causing each corner of the metal box embryo 5 to deform and bulge toward the peripheral wall of the die cavity S1 and to fill each approximately right-angled wall corner of the peripheral wall of the die cavity S1, and the hydroforming mold 4 is then removed. This step applies a downwardly pressing active force to the metal box embryo 5 to force each corner r1', r2' of the metal box embryo 5 to deform, bulge, and fill the lower and upper edge wall corners α1' and α2' of the die cavity S1. Specifically, while continuously filling the working fluid Li, by feeding the punch 42 to exert a downwardly pressing active force on the top sheet metal 5*b* of the metal box embryo 5 at the top part of the drawing, the lower and upper edges (i.e., the corners r1', r2' in the drawing) of the side sheet metals 5*a* and 5*c* of the metal box embryo 5 at the left and right sides of the drawing are forced to continuously deform and bulge in the direction indicated by the arrows in the drawing until the side sheet metals 5*a* and 5*c* of the metal box embryo 5 at the left and right sides of the drawing bulge and fill the lower edge and upper edge wall corners α1' and α2' of the die cavity S1 due to its material flow and ductility, such that the corners r1', r2' having angles approximately the same as the lower and upper edges wall corners α1', α2' of the die cavity S1 are formed on the lower and upper edges of the metal box embryo 5. As can be seen from the drawing, under the cooperation of the liquid pressure and the downwardly pressing punch 42, each corner r1' at the lower part of the drawing and each corner r2' at the upper art of the drawing of the metal embryo 2 of this embodiment can approximate right angles in cross section, as shown in the drawing.

Figure 23:
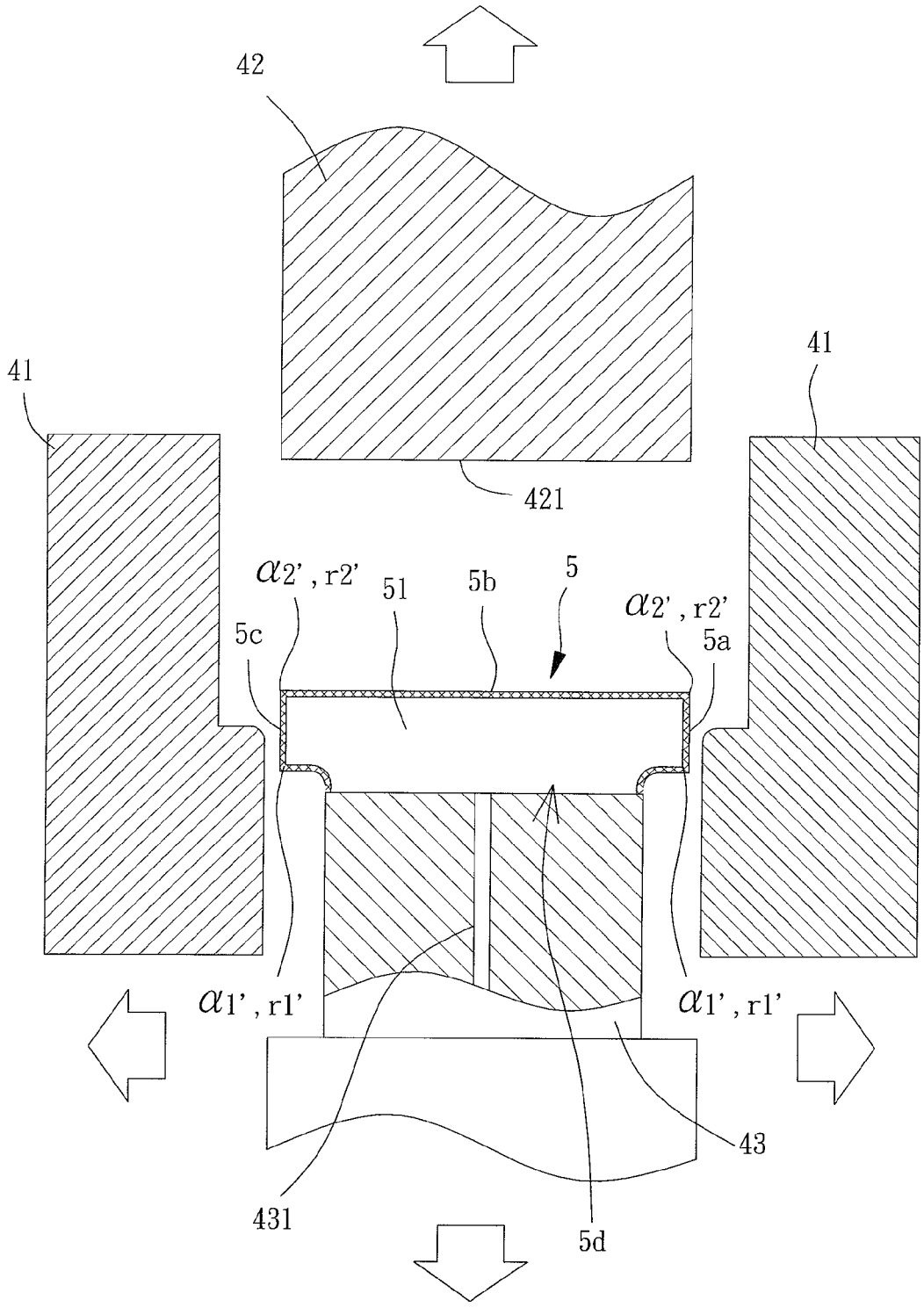
FIG. 23 is a schematic view of a sixth operational procedure of the hydroforming method for making a metal box according to the present invention.
Figure 24A:
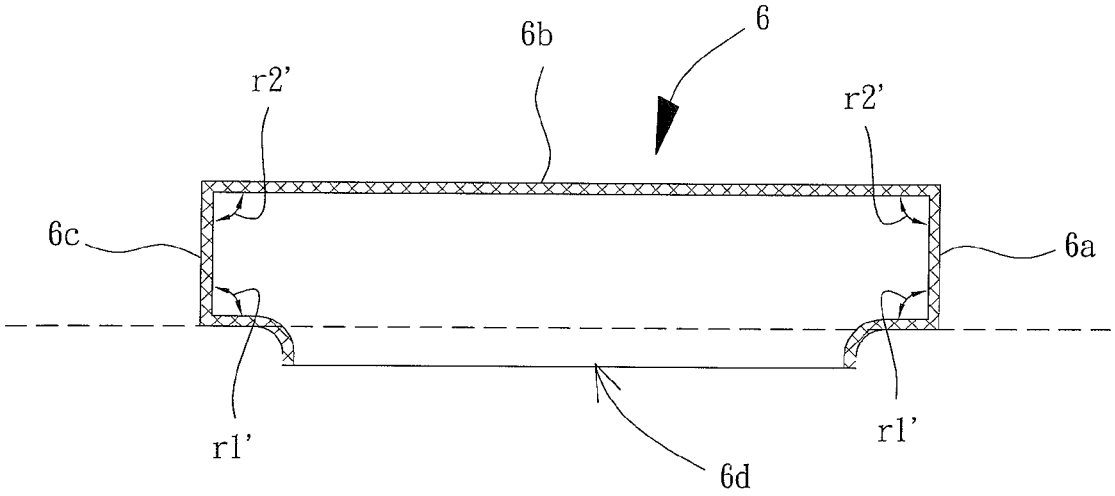
FIGS. 24*a* and 24*b* are schematic views of a seventh operational procedure of the hydroforming method for making a metal box according to the present invention.
Figure 24B:
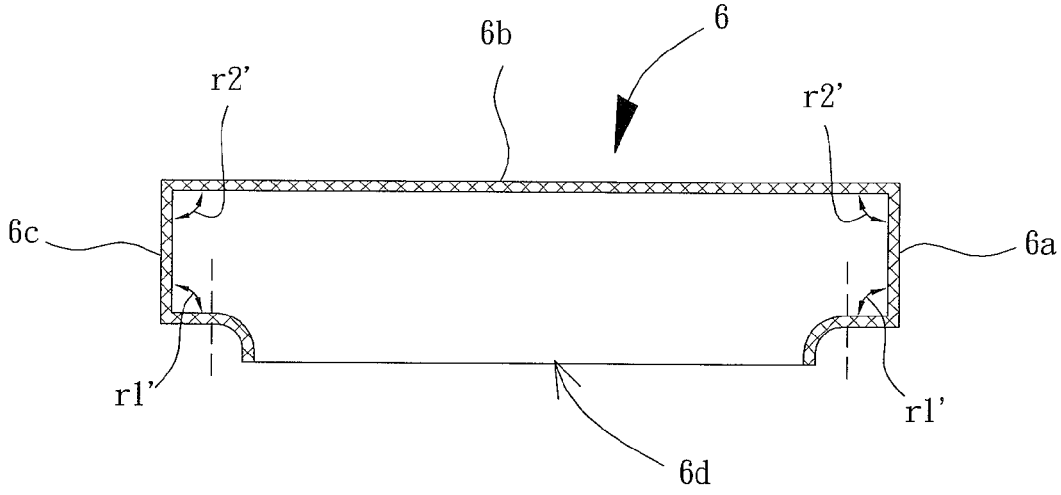

Thus, as can be seen from FIG. 23, a metal box (hereinafter referred to as "metal box 6") formed from the metal box embryo 5 is obtained after removing the hydroforming mold 4. The metal box 6 includes a plurality of side walls (see 6*a*, 6*b*, 6*c* in cross section in the drawing). As can be seen from FIG. 24*a* or 24*b*, the metal box 6 can be cut after formation of the metal box 6 to remove redundant material at the object-placing opening 6*d* of the metal box 6, finely producing the metal box 6 after trimming. The angle of each corner (see r1', r2' in the drawing) of the metal box 6 in this embodiment can approximate a right angle in cross section, as shown in the drawing. In view of the foregoing, the metal box 6 is produced by the hydroforming method according to the present invention. Furthermore, the minimal radius of each corner (see r1', r2' in the drawing) of the peripheral wall of the metal box 6 is 1.7 mm (R1.7) when a thickness of the sheet metals of the metal box 6 at the upper edge and lower edge wall corners of the die cavity S1 is 1.5 mm.

Based on the above concept, active forces in other directions can be provided under a different disposition of the hydroforming mold 4, which can be appreciated by a person having ordinary skill in the art of the invention. As an example, the push rod 43 or one of the side dies 41 is selectively moved to operate technical means in the manufacturing procedures, such as repeated feeding and retraction, producing metal boxes of different specifications but having the same specific angle.

In view of the foregoing, the main features of the hydroforming method for a metal box according to the present invention are that by using the working fluid L1 to provide a liquid pressure on the metal box embryo 5 and cooperating with the push rod 43 of the hydroforming mold 4 to supply material from the lower edge, the side sheet metals 5*a* and 5*c* can be forced to bulge. Furthermore, by using the hydroforming mold 4 to provide a downwardly pressing active force on the top sheet metal 5*b* of the metal box embryo 5, under feeding of the downwardly pressing active force cooperating with continuous liquid pressure, the metal box embryo 5 deforms and bulges until each corner of the metal box embryo 5 (the corners r1' and r2' in cross section in the drawing) and the wall corners (the upper edge wall corners α2' and the lower edge wall corners α1') of the die cavity S1 of the hydroforming mold 4 have approximately the same angle. A metal box 6, every angle of which approximates a right angle, can be obtained after removing the hydroforming mold, and redundant material adjacent to the object-placing opening 6*d* of the metal box 6 is removed according to need.

Accordingly, the hydroforming method for metal and a metal box according to the present invention allows the metal embryo and the metal box embryo to smoothly bulge and fill into each corner during the procedure of operating the push rod and the punch of the hydroforming mold to respectively feed into the die cavity of the hydroforming mold. Furthermore, by using excessive material in the upper or lower portion of each corner as the ductile material supply to form each corner under full expansion and deformation of the material, circular, elliptic, rectangular or polygonal hardware and metal boxes having approximately right angles can be formed while avoiding thinning and breakage in each corner of the hardware and the metal boxes. By using the method, the present invention can produce various types of hardware and metal boxes (every corner of which approximates a right angle), providing wide applications in casings for electronic gadgets, such as cell phones, cameras, computer main units, and televisions, or oil tank casings for vehicles.

Although the invention has been described with reference to the above preferred embodiments which should not be used to restrict the invention, various changes and amendment to the above embodiments by any person skilled in the art without departing from the spirit and scope of the invention are still within the scope of protection of the invention. The scope of the invention is limited by the accompanying claims.

What is claimed is:

1. A hydroforming method for metal comprising:

preparing a hydroforming mold, with the hydroforming mold including side dies, a punch, and a push rod to define a die cavity having a peripheral wall including corners;

providing a metal embryo, with the metal embryo including a bottom and a plurality of side walls having top edges, with the bottom and the plurality of side walls together defining an interior space, with the interior space having an opening;

placing the metal embryo into the die cavity, with the punch pressing against the bottom of the metal embryo, with the push rod facing the opening;

filling the interior space of the metal embryo with a working fluid via the opening of the metal embryo, with the working fluid exerting a pressure on the metal embryo;

moving the push rod toward the die cavity, with the push rod pressing against the working fluid and the top edges of the plurality of side walls of the metal embryo to bulge the plurality of side walls of the metal embryo; and moving the punch toward the die cavity to bulge the metal embryo to abut the peripheral wall of the die cavity and to fill corners of the peripheral wall of the die cavity, forming a hardware, wherein the punch is moved away from the die cavity while the push rod is moving toward the die cavity, and a velocity of the punch is smaller than a pushing velocity of the push rod.

2. The hydroforming method for metal as claimed in claim 1, wherein the punch is moved toward the die cavity before the push rod pushes the working fluid toward the die cavity, thereby pressing the metal embryo.

3. A hydroforming method for metal comprising:

preparing a hydroforming mold, with the hydroforming mold including side dies, a punch, and a push rod to define a die cavity having a peripheral wall including corners;

providing a metal embryo, with the metal embryo including a bottom and a plurality of side walls having top edges, with the bottom and the plurality of side walls together defining an interior space, with the interior space having an opening;

placing the metal embryo into the die cavity, with the punch pressing against the bottom of the metal embryo, with the push rod facing the opening;

filling the interior space of the metal embryo with a working fluid via the opening of the metal embryo, with the working fluid exerting a pressure on the metal embryo;

moving the push rod toward the die cavity, with the push rod pressing against the working fluid and the top edges of the plurality of side walls of the metal embryo to bulge the plurality of side walls of the metal embryo; and moving the punch toward the die cavity to bulge the metal embryo to abut the peripheral wall of the die cavity and to fill corners of the peripheral wall of the die cavity, forming a hardware, wherein the punch is moved toward the die cavity before the push rod pushes the working fluid toward the die cavity, thereby pressing the metal embryo.

4. The hydroforming method for metal as claimed in claim 3, wherein the punch presses against all or a portion of the bottom.

5. The hydroforming method for metal as claimed in claim 3, wherein the working fluid continuously fills the interior space via the opening of the metal embryo to assure that the working fluid provides a continuous liquid pressure in the interior space.

6. The hydroforming method for metal as claimed in claim 3, further comprising: removing the hydroforming mold and obtaining the hardware; and cutting redundant material of the hardware.

7. The hydroforming method for metal as claimed in claim 3, wherein the side dies and the punch form a first corner.

8. The hydroforming method for metal as claimed in claim 7, wherein a shoulder extends from a portion of each side die adjacent to the push rod, and the shoulder and the side die form a second corner.

9. The hydroforming method for metal as claimed in claim 3, wherein the push rod includes a fluid injection channel through which the working fluid is filled.

10. The hydroforming method for metal as claimed in claim 3, wherein a maximum inner radius of each corner of the hardware is 1.7 mm when a thickness of the sheet metal of the hardware at the corner of the die cavity is 1.5 mm.

11. The hydroforming method for metal as claimed in claim 3, wherein a shape of the metal embryo is same as the die cavity defined by the side dies, the punch and the push rod.

12. The hydroforming method for metal as claimed in claim 3, wherein the metal embryo is circular, elliptic, rectangular, or polygonal.

13. A hydroforming method for a metal box comprising:

preparing a hydroforming mold including side dies, a punch, and a push rod defining a die cavity having an interior and a peripheral wall including approximately right-angle corners;

providing a metal box embryo formed by sheet metals, with the metal box embryo including a plurality of walls, corners and an interior having an opening;

placing the metal box embryo into the die cavity formed by the side dies, the punch and the push rod of the hydroforming mold, with the punch pressing against one of the plurality of walls of the metal box embryo;

filling a working fluid into the die cavity of the hydroforming mold, with the working fluid filling the interior of the metal box embryo via the opening of the metal box embryo, with the working fluid exerting a pressure on the metal box embryo to bulge the sheet metals outward, and feeding the push rod of the hydroforming mold toward the interior of the die cavity until the sheet metals of the metal box embryo keep bulging into the die cavity and pressing against the side dies of the hydroforming mold; and operating the punch of the hydroforming mold to feed the punch toward the die cavity to press the metal box embryo, causing each corner of the metal box embryo to deform toward the peripheral wall of the die cavity and to fill each approximately right-angled corner formed by the peripheral wall of the die cavity, and then removing the hydroforming mold.

14. The hydroforming method for a metal box as claimed in claim 13, wherein the punch is moved away from the die cavity while feeding the push rod of the hydroforming mold toward the interior of the die cavity, forcing the sheet metals of the metal box embryo to bulge and expand to press against the punch and the side dies.

15. The hydroforming method for a metal box as claimed in claim 13, wherein the approximately right-angled corners of the peripheral wall of the die cavity include a set of lower edge wall corners and a set of upper edge wall corners, with the set of lower edge wall corners located adjacent to the push rod, and with set of the upper edge wall corners located adjacent to the punch.

16. The hydroforming method for a metal box as claimed in claim 15, wherein when the punch of the hydroforming mold is operated to feed into the die cavity, the punch exerts a downward pressing force to one of the sheet metals of the metal box embryo pressed by the punch, causing each corner of the metal box embryo to deform and bulge to fill the sets of lower and upper edge wall corners of the die cavity.

17. The hydroforming method for a metal box as claimed in claim 15, wherein a metal box is obtained after removing the hydroforming mold, with the metal box including a plurality of side walls and an object-placing opening, and with redundant material at the object-placing opening is cut after forming the metal box.

18. The hydroforming method for a metal box as claimed in claim 17, wherein a minimal radius of each corner of the peripheral wall is 1.7 mm when a thickness of the sheet metals of the metal box embryo at the sets of upper edge wall corners and the lower edge wall corners of the die cavity is 1.5 mm.

19. The hydroforming method for a metal box as claimed in claim 13, wherein the push rod includes a fluid injection channel through which the working fluid is filled.

* * * * *